US007870650B2

(12) United States Patent
Keyaki et al.

(10) Patent No.: US 7,870,650 B2
(45) Date of Patent: Jan. 18, 2011

(54) SLIDE FASTENER SLIDER

(75) Inventors: Keiichi Keyaki, Toyama-ken (JP); Yoshikazu Hamada, Toyama-ken (JP)

(73) Assignee: YKK Corporation (JP)

( * ) Notice: Subject to any disclaimer, the term of this patent is extended or adjusted under 35 U.S.C. 154(b) by 295 days.

(21) Appl. No.: 12/045,808

(22) Filed: Mar. 11, 2008

(65) Prior Publication Data

US 2008/0222854 A1 Sep. 18, 2008

(30) Foreign Application Priority Data

Mar. 16, 2007 (JP) ..... 2007-069100

(51) Int. Cl.
*A44B 19/30* (2006.01)

(52) U.S. Cl. ..... 24/424; 24/421; 24/429

(58) Field of Classification Search ..... 24/418, 24/419, 420, 421, 422, 423, 424, 429
See application file for complete search history.

(56) References Cited

U.S. PATENT DOCUMENTS

| | | | | |
|---|---|---|---|---|
| 2,554,252 | A * | 5/1951 | Jones | 24/420 |
| 2,646,605 | A * | 7/1953 | Morin | 24/424 |
| 4,624,032 | A * | 11/1986 | Ishii et al. | 24/429 |
| 4,829,638 | A | 5/1989 | Ishii et al. | |
| 5,068,950 | A * | 12/1991 | Yuki | 24/429 |
| 5,167,052 | A | 12/1992 | Aoki et al. | |
| 5,551,129 | A * | 9/1996 | Chu | 24/429 |
| 5,996,188 | A * | 12/1999 | Yaguramaki et al. | 24/424 |
| 6,523,232 | B2 * | 2/2003 | Chen | 24/431 |
| 7,219,402 | B2 * | 5/2007 | Yamazaki | 24/429 |

FOREIGN PATENT DOCUMENTS

| | | | |
|---|---|---|---|
| EP | 0273324 | A1 | 7/1988 |
| EP | 0492403 | A1 | 7/1992 |
| JP | 61-247402 | A | 11/1986 |
| JP | 63-99512 | U | 6/1988 |

* cited by examiner

*Primary Examiner*—Robert J Sandy
*Assistant Examiner*—Michael Lee
(74) *Attorney, Agent, or Firm*—Kilpatrick Stockton LLP

(57) ABSTRACT

A slide fastener slider comprising: a slider body; a pull tab holder body attached to the slider body in a cantilevered state with one end portion thereof fixed to a top face side of the slider body; an opening/closing member disposed slidably on the slider body so as to open and close a gap formed between an other end portion of the pull tab holder body and the upper blade; and an elastic member for urging the opening/closing member to a closing position of the gap, so that a pull tab is detachably held between the slider body and the pull tab holder body, the slider further comprising a fitting sliding structure in which the pull tab holder body is fitted to the slider body from a front or rear end thereof so as to be relatively slidable in a length direction of the slider body.

7 Claims, 17 Drawing Sheets

SLIDE FASTENER SLIDER

INCORPORATION BY REFERENCE

The present application claims priority under 35 U.S.C. §119 to Japanese Patent Application No. 2007-069100 filed on Mar. 16, 2007. The content of the application is incorporated herein by reference in its entirety.

BACKGROUND OF THE INVENTION

1. Field of the Invention

The present invention relates to a slide fastener slider in which a pull tab can be attached to or detached from a slider body easily, and more particularly, to a slide fastener slider capable of improving productivity and reducing production cost by improving the assembly efficiency of the slider.

2. Description of Related Art

Conventionally, slide fasteners have been attached to an opening of clothes or bags, etc. in order to open/close the openings. Generally, a slider for use in such a slide fastener is comprised of three components, a slider body having upper and lower blades, connected at their front end side with a predetermined gap by a connecting post, a pull tab for operating the slider, and a pull tab holder body for holding the pull tab movably and rotatably with respect to the top face of the slider body.

To meet a demand or preference of a customer easily, for example, manufacturers of clothes or bags are demanded to attach various types of pull tags different in color or shape to the slide fastener slider body or replace the pull tab attached to the slider body with another type of pull tab. For this reason, a number of sliders which allow the pull tab to be attached to/detached from the slider body arbitrarily have been conventionally available.

An example of the slider which allows the pull tab to be attached thereto/detached therefrom has been disclosed in Japanese Utility Model Publication No. 4-32974. The slider disclosed in Japanese Utility Model Publication No. 4-32974 not only allows the pull tab to be attached thereto/detached therefrom but also is equipped with an automatic stop mechanism which automatically stops sliding of the slider with respect to a fastener element row when opening/closing of the fastener with the pull tab is not executed.

The slider of Japanese Utility Model Publication No. 4-32974 will be described with reference to FIGS. 27 to 30. In a slider 100 of Japanese Utility Model Publication No. 4-32974, as shown in FIGS. 27 and 28, an attaching piece 116 having a shaft hole 115 is erected on the top face of an upper blade of a slider body 101. One end portion of a pull tab holder body 102 which is in a downwardly concave shape is engaged with this attaching piece 116 by use of a pin 117, so that the pull tab holder body is fixed in a cantilever style and a locking pawl body 103 is journaled swingably in a vertical direction. Further, an engagement window hole 104 is formed in the top blade of the slider body 101 such that the engagement window hole 104 penetrates the upper blade vertically.

An engaging pawl 105 projecting into an element guide passage in the slider body 101 from the engagement window hole 104 formed in the slider body 101 and an operating concave groove 107 which is open to the rear mouth side of the upper blade for accommodating the mounting shaft portion of the pull tab 106 are formed at the front end portion of the locking pawl body 103. The bottom face of a proximal portion of the locking pawl body 103 is always urged by a spring force of a first coil spring 118 loaded in a small hole formed in the upper blade in order for the locking pawl 105 of the locking pawl body 103 to project into the element guide passage from the engagement window hole 104, as shown in FIG. 27.

The pull tab holder body 102 includes recess spaces 111 formed in a concave shape near the rear mouth side of right and left wall portions, a storage space 112 formed in a concave shape near the shoulder mouth side, and a continuous edge portion 113 continuously formed between the recess space 111 and the storage space 112. A gap portion 108 is formed between an end portion on the rear mouth side of the pull tab holder body 102 and the upper blade of the slider body 101. This gap portion 108 allows the mounting shaft portion 106*a* of the pull tab 106 to pass therethrough. Further, an opening/closing member 109 for opening/closing the gap portion 108 is disposed on the upper blade of the slider body 101 such that the opening/closing member 109 can slide between a gap closing position near the rear mouth side and a gap opening position near the shoulder mouth side. The opening/closing member 109 is always urged in a direction toward the gap closing position by a second coil spring 120.

The opening/closing member 109 is formed in a substantially U shape as seen in its plan view as shown in FIG. 27. A first closing portion 110 projecting upward and a second closing portion 114 are formed on the proximal end side and front end side of each of two-forked arm portions of the opening/closing member 109. Consequently, when the opening/closing member 109 is located at the gap closing position because it is urged, the opening/closing member 109 closes the gap portion 108 with the first closing member 110 such that the mounting shaft portion 106*a* of the pull tab 106 does not to pass through the gap portion. In addition, a gap between the continuous edge portion 113 of the pull tab holder body 102 and the upper blade of the slider body 101 is closed with the second closing portion 114 such that the mounting shaft portion 106*a* of the pull tab 106 does not to pass through the gap.

In the slider 100 of Japanese Utility Model Publication No. 4-32974 having the above-described structure, as shown in FIGS. 28 to 30, a primary assembly 119 is constructed by assembling the locking pawl body 103, the opening/closing member 109, the pull tab holder body 102 and the like on the slider body 101, and then, the pull tab 106 is detachably attached to the primary assembly 119.

According to Japanese Utility Model Publication No. 4-32974, when attaching the pull tab 106 to the primary assembly 119, as a first process, the mounting shaft portion 106*a* of the pull tab 106 is pushed into the gap portion 108 between the slider body 101 and the pull tab holder body 102 as shown in FIGS. 28 and 29. Consequently, the rear end of the first closing portion 110 of the opening/closing member 109 is pressed by the mounting shaft portion 106*a* of the pull tab 106, so that as shown in FIG. 28, the opening/closing member 109 is slid forward from the end portion on the rear mouth side of the pull tab holder body 102. Consequently, the gap portion 108 closed by the first closing portion 110 is opened for the mounting shaft portion 106*a* of the pull tab 106 to pass therethrough. Next, when the mounting shaft portion 106*a* of the pull tab 106 is moved from the gap portion 108 into the recess space 111 in the pull tab holder body 102, the opening/closing member 109 is returned to its original closing position by a restoration force of the second coil spring 120 as shown in FIG. 30.

Next, as a second process, the mounting shaft portion 106*a* of the pull tab 106 is moved form the recess space 111 of the pull tab holder body 102 into the concave portion formed between the first and second closing portions 110 and 114 of the opening/closing member 109 as shown in FIG. 30.

As a third process, if the mounting shaft portion 106*a* of the pull tab 106 is pushed forward of the slider 100 again, the opening/closing member 109 is slid as shown with a dotted line in FIG. 29, and the second closing portion 114 is moved from the closing position through the gap between the continuous edge portion 113 of the pull tab holder body 102 and the slider body 101. At this time, the mounting shaft portion 106*a* of the pull tab 106 passes the bottom end of the continuous edge portion 113 in a state in which the mounting shaft portion 106*a* is accommodated in the concave portion in the opening/closing member 109 and is moved to downward of the storage space 112 in the pull tab holder body 102 and at the same time, moved into the operating concave groove 107 in the locking pawl body 103.

Thereafter, as a fourth process, if the mounting shaft portion 106*a* of the pull tab 106 is moved into the storage space 112 of the pull tab holder body 102 by moving the pull tab 106 upward, interference between the mounting shaft portion 106*a* and the second closing portion 114 of the opening/closing member 109 is eliminated. With this, the opening/closing member 109 is returned to the gap closing position by a spring force of the second coil spring 120, so that the attachment of the pull tab 106 is completed. The pull tab 106 attached to the slider 100 in this way is prevented from freely slipping out of the slider 100 because the opening/closing member 109 is urged to the gap closing position by the second coil spring 120.

On the other hand, to remove the pull tab 106 from the slider 100 after attachment of the pull tab 106, the opening/closing member 109 is moved from the gap closing position to the gap opening position resisting the urging force of the second coil spring 120, and with the opening/closing member 109 held at the gap opening position, the pull tab 106 is moved in an inverse procedure to described above. Consequently, the pull tab 106 can be removed easily and thereafter, a new pull tab different from the pull tab 106 can be attached.

When the pull tab 106 is gripped and pulled obliquely upward or in a direction in which the slider slides so as to operate the slider 100 provided with the pull tab 106 as described, the locking pawl body 103 is raised resisting an urging force of the first coil spring 118 by the mounting shaft portion 106*a* of the pull tab 106, so that the engaging pawl 105 of the locking pawl body 103 is retreated from the element guide passage of the slider body 101. Consequently, the slider 100 can be slid freely with respect to the fastener chain so as to engage or disengage the element rows of the fastener chain.

When the slider 100 is stopped and the pull tab 106 is released from the fingers, the locking pawl body 103 is urged by the first coil spring 118 to cause the engaging pawl 105 of the locking pawl body 103 to project into the element guide passage from the engagement window hole 104 in the upper blade. As a result, the engaging pawl 105 is automatically inserted and engaged into elements of the fastener chain to stop the moving of the slider.

Conventionally, in case of assembling the slide fastener slider by attaching the locking pawl body, the pull tab holder body, the coil spring and the like onto the slider body, the slider assembly work is manually carried out for each slider, or a continuous assembly apparatus having a turn table disclosed in Japanese Patent Laid-Open Publication No. 61-247402 is employed.

The slider continuous assembly apparatus described in Japanese Patent Laid-Open Publication No. 61-247402 has the turn table in which a plurality of holding portions (groove portions) for the slider body are formed radiantly in a diameter direction. Further, along the outer periphery of the turn table, a supply portion for the slider body, a supply portion for other component, a caulking portion, an optical sensor (assembly inspection portion) and other working sections are disposed at each predetermined position in order.

In this slider continuous assembly apparatus, the direction in which each component is supplied to the turn table and a working direction at each working section are set along the radius direction of the turn table. With this configuration, respective components such as the pull tab holder body are supplied to the slider body along the longitudinal direction and vertical direction of the slider body and assembled together.

Thus, upon the actual assembly work of the slider, the slider body is supplied to the holding portion disposed on the turn table with the longitudinal direction of the slider body aligned with the radius direction of the turn table. Thereafter, by intermittently turning the turn table holding the slider body by a predetermined angle, other components are supplied to the slider body at each position in which the turn table is stopped and caulked in order, whereby the sliders can be assembled mechanically and continuously.

The slider continuous assembly apparatus of Japanese Patent Laid-Open Publication No. 61-247402 including such a turn table can effectively assemble the slider having an automatic stop mechanism, and select a defective product mechanically. Accordingly, the slider with the automatic stop mechanism assembled appropriately can be obtained securely so as to enable mass production of high quality sliders.

In the slider as described in Japanese Utility Model Publication No. 4-32974 which allows the pull tab to be detachably attached thereto and has the automatic stop mechanism, the pin 117 is inserted into the shaft hole 115 in the attaching pieces 116 erected from the upper blade from sideways (in the right and left direction) with pin holes formed in the pull tab holder body 102 and the locking pawl body 103 aligned with each other in order to attach and fix the pull tab holder body 102 and the locking pawl body 103 onto the slider body 101. Further, the same pin 117 is fixed to the attaching piece 116 by caulking or the like.

However, in case of assembling the slider of Japanese Utility Model Publication No. 4-32974 by the manual operation, the work of aligning the shaft hole 115 in the attaching piece 116 with the respective pin holes in the pull tab holder body 102 and the locking pawl body 103 and inserting and fixing the pin 117 is extremely complicated, thereby taking much working time. Consequently, productivity of the slider drops, which is a prominent factor for increasing manufacturing cost.

On the other hand, to assemble the sliders of Japanese Utility Model Publication No. 4-32974 continuously and effectively, for example, it can be considered to execute the assembly work for the sliders using the slider continuous assembly apparatus having the turn table as described in Japanese Patent Laid-Open Publication No. 61-247402. In this case, the slider continuous assembly apparatus of Japanese Patent Laid-Open Publication No. 61-247402 is constructed so that as describe above, the directions of supplying of components and assembly are basically set along the radius direction of the turn table. As a result, although works accompanying movement in the back and forth direction and in the vertical direction with respect to the slider body can be carried out easily, works in the right and left direction (peripheral direction of the turn table) with respect to the slider body cannot be carried out. For this reason, to attach the pull tab holder body 102 and the locking pawl body 103 by inserting the pin 117 shown in FIG. 27 from sideways of the slider body, it is necessary to change the design of the apparatus itself so as to provide with means for supplying a pin from sideways of the slider body and fixing that pin by caulking or the like.

However, if the design of the slider continuous assembly apparatus is changed, a mechanism which operates in the right and left direction with respect to the slider body needs to be provided, and thus, the configuration of the apparatus itself becomes complicated, which is a problem to be solved. Further, to supply the pin from sideways to the slider body, a sufficient area needs to be secured on the right and left sides of the slider body held on the turn table, for example, by increasing the size or rotation angle of the turn table. Thus, the slider continuous assembly apparatus is enlarged in size and productivity of the slider is dropped.

By the way, generally, the slider body, the pull tab holder body and the like of the slide fastener slider are manufactured by die casting or injection molding. According to a conventional mold design, to mold the slider body and pull tab holder body, a plurality of molding cavities are formed in molds (upper mold and lower mold) and the respective molding cavities are connected with runners. Then, when a single molding operation is carried out, a plurality of molded products can be obtained, in order to aim at reduction of the manufacturing cost.

However, the slider body 101 and the pull tab holder body 102 for use in the slider 100 shown in FIG. 27 have the shaft hole 115 or the pin hole in which the pin 117 is to be inserted and fixed. For this reason, when die casting or injection molding the slider body 101 or the pull tab holder body 102, a slide core which moves sideways with respect to the slider body needs to be provided in the mold structure in order to form the shaft hole 115 or the pin hole. This makes the mold structure complex and further requires a space for provision of the slide core in the mold structure, thereby reducing the quantity of molded products which can be obtained by a single molding operation using the mold structure. Accordingly, the slider which allows a pull tab to be attached thereto or detached therefrom as mentioned in the Japanese Utility Model Publication No. 4-32974 has such a problem that cost for respective components such as the slide body and the pull tab holder body is increased.

SUMMARY OF THE INVENTION

The present invention has been achieved in views of the above-described conventional problems, and an object of the invention is to provide a slide fastener slider which allows a pull tab to be detachably attached thereto, can improve productivity by effective assembly work and increase the quantity of molded products obtained by a single molding when slider bodies or pull tab holding bodies are formed, thereby reducing manufacturing cost.

To achieve the above-described object, the present invention provides a slide fastener slider comprising: a slider body having an upper blade and a lower blade which are connected through a connecting post disposed on each front end side thereof, and a rear mouth at each rear end thereof; a pull tab holder body which is attached to the slider body in a cantilevered state with one end portion thereof fixed to a top face side of the slider body; an opening/closing member which is disposed slidably on the slider body so as to open and close a gap formed between an other end portion of the pull tab holder body and the upper blade; and an elastic member for urging the opening/closing member to a closing position of the gap, the opening/closing member being slid with resisting an urging of the elastic member to open the gap, so that the pull tab is inserted or removed through the gap when the gap is opened, whereby the pull tab is detachably held between the slider body and the pull tab holder body, the slide fastener slider being characterized by comprising a fitting sliding structure in which the pull tab holder body is fitted to the slider body from a front end or a rear end thereof so as to be relatively slidable in a length direction of the slider body.

Preferably, the fitting sliding structure comprises: flanges which are formed along a length direction of any one component of the slider body and the pull tab holder body; and flange sliding grooves which are formed along a length direction of an other component to allow the flanges to be fitted thereto and slid thereon.

Preferably, the flanges are disposed on right and left side surfaces of the one end portion of the pull tab holder body, and the flange sliding grooves are disposed at a front end portion or a rear end portion of the upper blade of the slider body.

Further, in the present invention, preferably, the slider comprises a locking pawl body having a proximal portion, an arm portion extending from the proximal portion and a pawl portion formed at a front end portion of the arm portion, the slider body comprises an element guide passage formed between the upper blade and the lower blade and a pawl support portion which is provided on a top face of the upper blade so as to support the locking pawl body swingably in a vertical direction, and the locking pawl body is supported pivotally so as to project the pawl portion into the element guide passage usually, upon being urged by urging means having elasticity, and so as to retreat the pawl portion from the element guide passage upon receiving an operation, when the pull tab is operated.

Preferably, the urging means is constituted of a leaf spring. Further preferably, the leaf spring is provided separately from the locking pawl body and disposed on the slider body or the pull tab holder body. Alternatively, the leaf spring may be integrated with the locking pawl body.

Preferably, the pull tab holder body is fixed to the upper blade or the pawl support portion by caulking.

The slide fastener slider of the present invention has a fitting sliding structure in which the pull tab holder body for holding the pull tab such that the pull tab can be attached to and detached from the slider body is attached to the top face side of the slider body in a cantilevered state by being fitted from the front end or rear end of the slider body and slid in the length direction of the slider body. By attaching the pull tab holder body to the slider body by fitting and sliding it relatively, the slider can be assembled easily without use of any pin to be inserted from sideways of the slider body like the slider of the Japanese Utility Model Publication No. 4-32974 (see FIG. 27).

Therefore, when executing the assembly work for the slider using, for example, the continuous assembly apparatus having the turn table, respective components such as the pull tab holder body can be assembled to the slider body by moving them in the back and forth direction and in the vertical direction of the slider body. This eliminates the necessity of providing the apparatus with any mechanism which operates in the right and left direction with respect to the slider body held on the turn table and also eliminates the necessity of securing extra space in the peripheral direction of the turn table. Consequently, enlargement of the continuous assembly apparatus can be prevented and the assembly of the slider can be carried out effectively, thereby improving the productivity.

On the other hand, when assembling the slider by manual operation, any complicated work of aligning the pin holes and inserting the pin required in the conventional technique can be omitted to achieve the effective assembly of the slider, whereby productivity of the slider can be improved.

Further, because the slider of the present invention has the fitting sliding structure, any shaft hole or pin hole penetrating the slider body or the pull tab holder body in the right and left direction is not necessary. Thus, when die casting or injection molding these components, a mold structure using no slide core may be adopted. Therefore, the mold structure can be constructed easily as compared with a case of manufacturing a conventional slider which allows its pull tab to be detachably attached. In addition, by forming a plurality of molding cavities in the mold structure, the quantity of the slider bodies or pull tab holder bodies which can be obtained by a single molding can be increased, thereby reducing the unit price of the slider.

The slide fastener slider of the present invention includes the flanges provided in the length direction of any one of the slider body and the pull tab holder body, and the flange sliding grooves formed in the length direction of the other component to allow the flanges to be fitted thereto and slid thereon. With this configuration, the fitting sliding structure can be formed easily to facilitate attachment of the pull tab holder body.

Particularly, in this case, if the flanges are disposed on the right and left side surfaces at one end portion of the pull tab holder body and the flange sliding grooves are disposed at the front end or rear end of the slider body, the pull tab holder body can be attached easily in a cantilevered state by the fitting sliding structure composed of the flanges and the flange sliding grooves, and the fixing of the pull tab holder body can be stabilized.

The slide fastener slider of the present invention includes the locking pawl body having the pawl portion, and the slider body includes an element guide passage formed between the upper blade and the lower blade and a pawl support portion which is provided on the top face of the upper blade so as to support the locking pawl body swingably in a vertical direction. The locking pawl body is supported pivotally so as to usually, upon being urged by urging means having elasticity, project the pawl portion into the element guide passage, and when the pull tab is operated, retreat the pawl portion from the element guide passage upon receiving the operation. Consequently, the slider of the present invention can be equipped with the automatic stop mechanism for automatically stopping the sliding of the slider with respect to the fastener element row passed through the element guide passage in the slider body.

In this case, if the urging means is constructed of a leaf spring, the locking pawl body can be urged securely, and manufacturing cost can be suppressed as compared with a case of constituting the urging means with a coil spring. In this case, the leaf spring may be provided separately from the locking pawl body or may be integrated with the locking pawl body. For example, if the leaf spring is provided separately from the locking pawl body, disposing the leaf spring in the slider body or the pull tab holder body enables the locking pawl body to be urged securely. Further, the respective components of the slider can be formed easily to facilitate assembly of the slider. Furthermore, integrating the leaf spring with the locking pawl body makes it possible to reduce the quantity of the components of the slider.

Moreover, in the slide fastener slider of the present invention, the pull tab holder body is fixed to the upper blade or the pawl body support portion by caulking. With this configuration, the pull tab holder body can be fixed to the slider body more securely, thereby achieving a more solid slider assembling. The effects which the present invention exerts are considerably great.

DETAILED DESCRIPTION OF THE PREFERRED EMBODIMENTS

Hereinafter, preferred embodiments of the present invention will be described in detail with reference to the accompanying drawings.

First Embodiment

Figure 1:
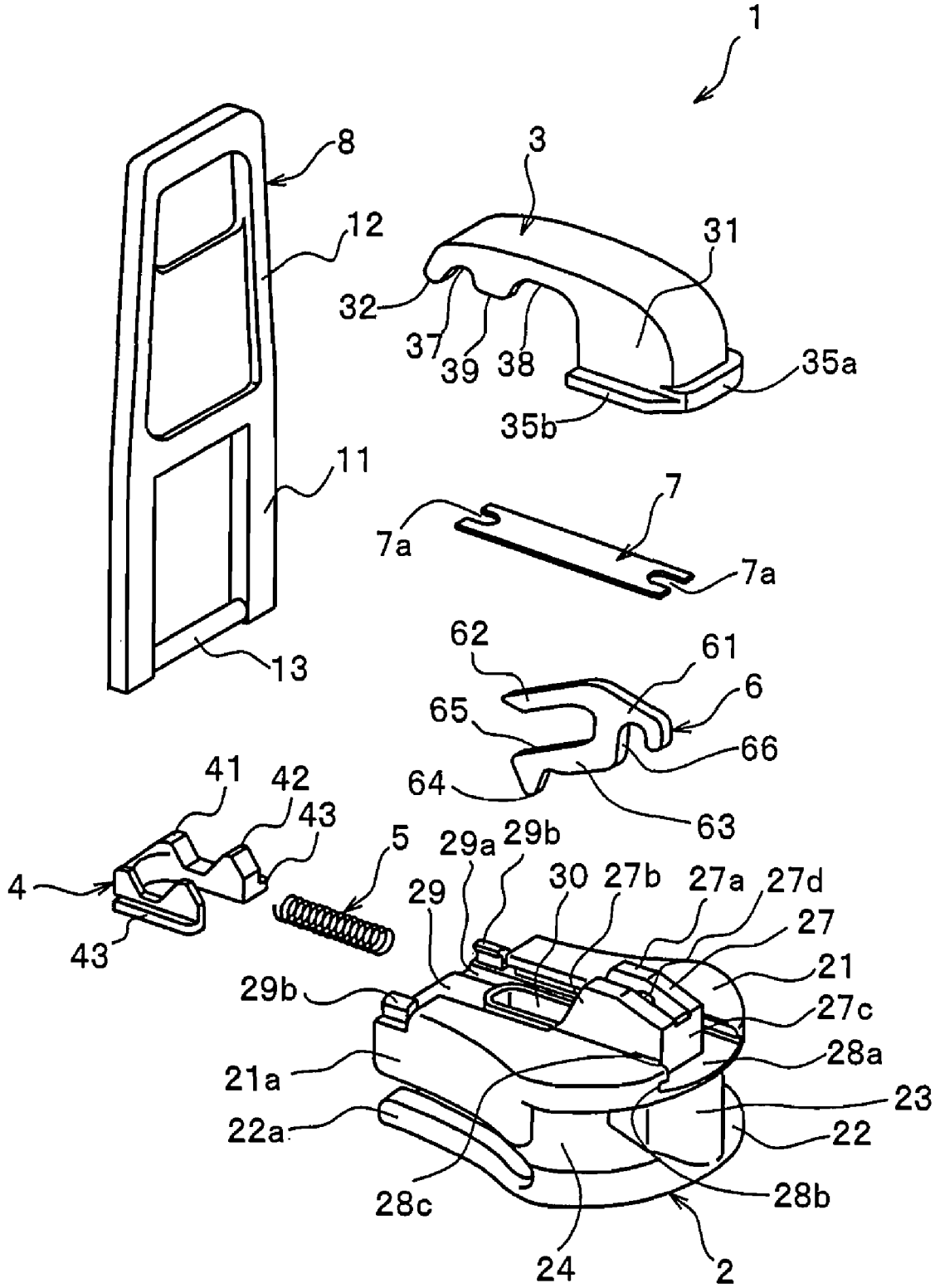
FIG. 1 is a perspective view showing a state in which components constituting a slide fastener slider according to a first embodiment of the present invention are disassembled.
Figure 6:
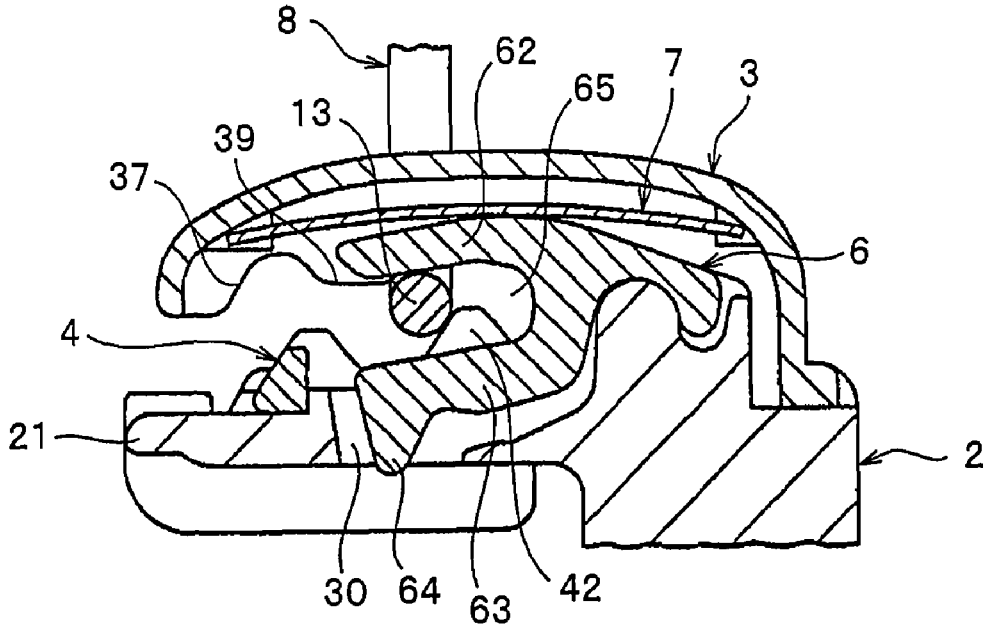
FIG. 6 is a longitudinal sectional view for explaining the procedure for moving the shaft portion of the pull tab into an accommodating portion in the pull tab holder body by sliding the opening/closing member.
Figure 7:
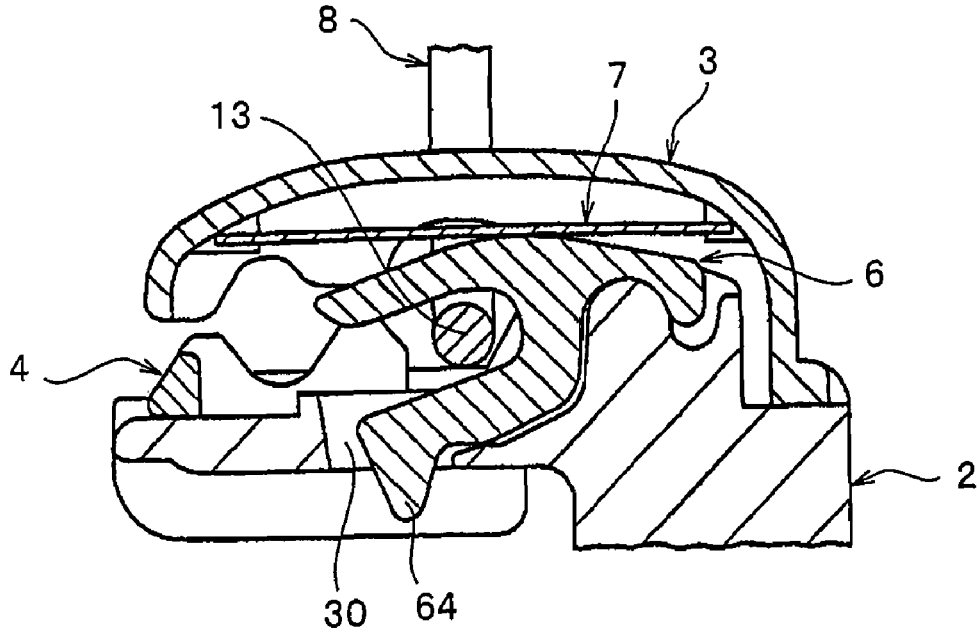
FIG. 7 is a longitudinal sectional view showing a state in which the shaft portion of the pull tab is moved into the accommodating portion of the pull tab holder body so that the pull tab is attached.
Figure 8:
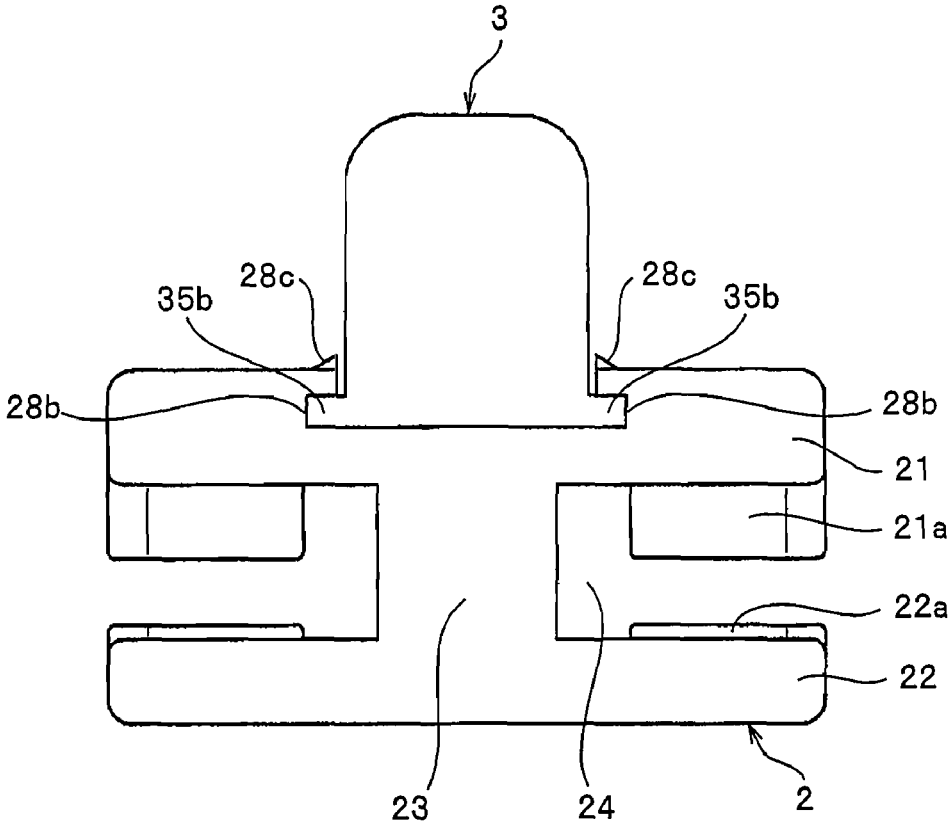
FIG. 8 is a front view showing the primary assembly before fixing by caulking.
Figure 9:
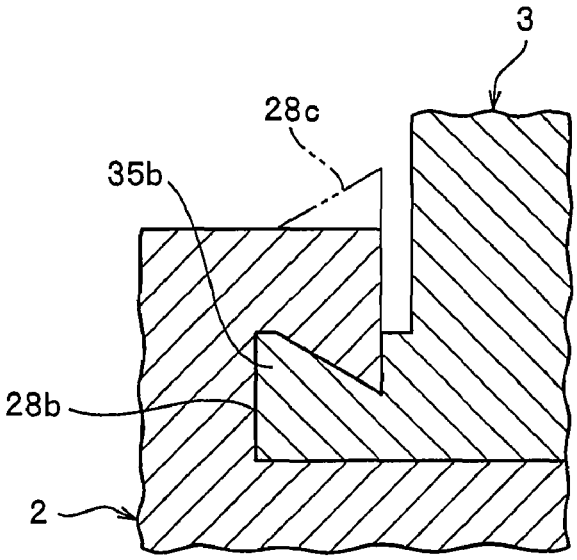
FIG. 9 is a major portion enlarged view for explaining fixing of the pull tab holder body by caulking an upper blade.
Figure 10:
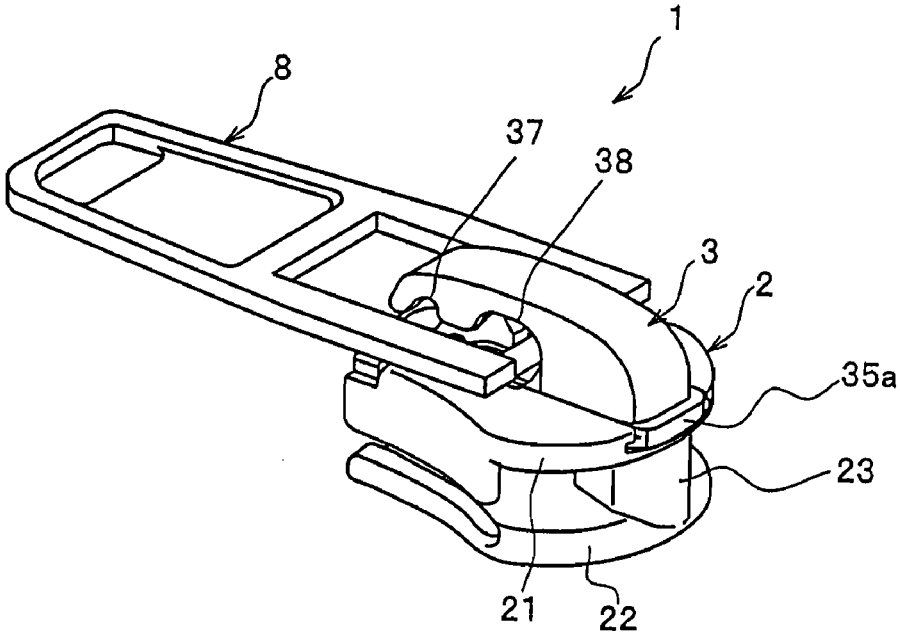
FIG. 10 is a perspective view of the slide fastener slider according to the first embodiment.

FIGS. 1 to 10 show a slide fastener slider according to a first embodiment of the present invention. FIG. 1 is a perspective view showing a state in which components constituting the slide fastener slider are disassembled, and FIGS. 2 to 7 are longitudinal sectional views showing the assembly procedure of the slider. FIG. 8 is a front view showing a state before the slider is fixed by caulking, and FIG. 9 is an enlarged view of major portions for explaining the fixing of the slider by caulking. FIG. 10 is a perspective view showing a state in which the slider is assembled.

As shown in FIG. 1, the slide fastener slider 1 according to the first embodiment is comprised of a slider body 2, a pull tab holder body 3, an opening/closing member 4, a coil spring 5 which is an elastic member, a locking pawl body 6, a leaf spring 7 as urging means, and a pull tab 8. In the slider 1 of the first embodiment, the pull tab holder body 3 and the locking pawl body 6 can be produced by pressing or die casting using a metallic material such as stainless and copper alloy. On the other hand, the slider body 2, the opening/closing member 4, and the pull tab 8 can be produced by die casting using a metallic material such as aluminum alloy and zinc alloy. Instead of the metallic material, these components can be produced by injection molding using a thermoplastic resin such as polyamide, polypropylene, polyacetal and polybutylene terephthalate or a thermoplastic resin material supplied with an abrasion resistant reinforcing agent.

Figure 2:
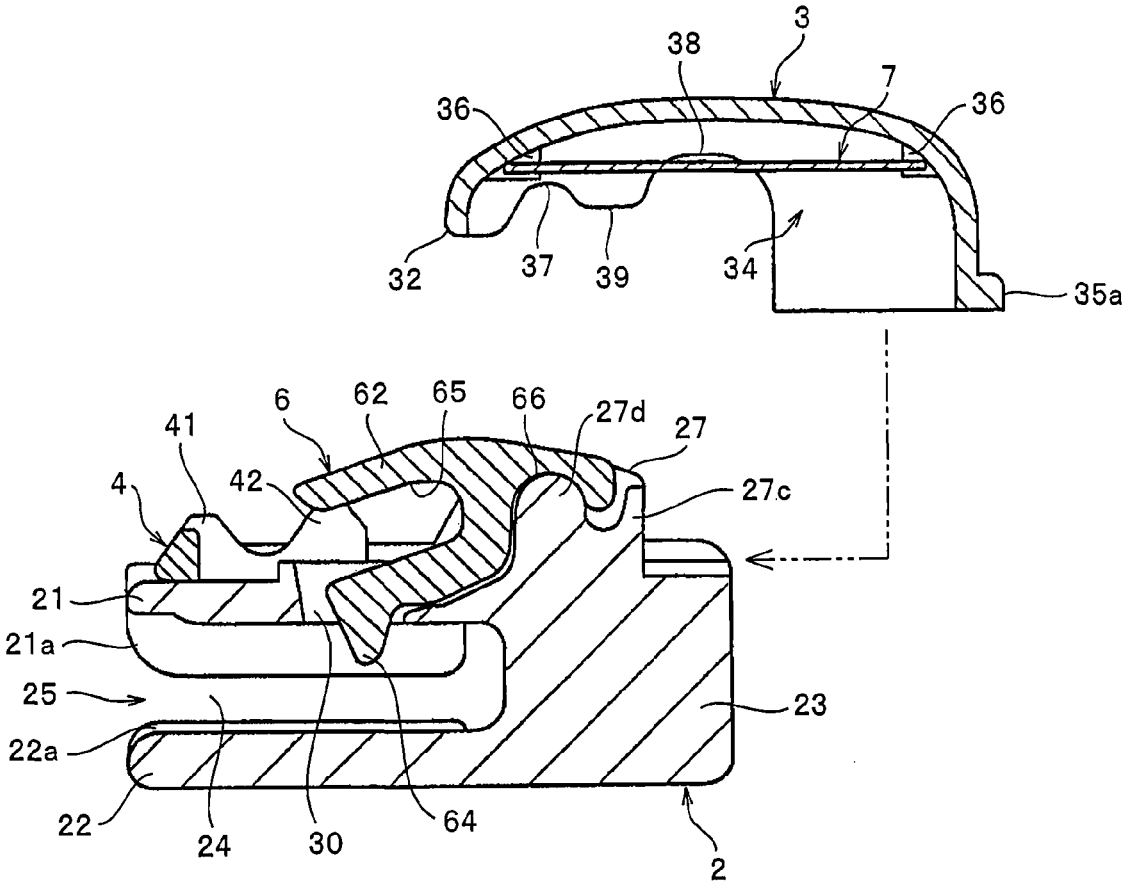
FIG. 2 is a longitudinal sectional view for explaining the procedure for fitting a pull tab holder body into a slider body.

As shown in FIGS. 1 and 2, the slider body 2 is comprised of an upper blade 21, a lower blade 22 and a connecting post 23 for connecting front ends of the upper and lower blades 21, 22. Right and left upper and lower flanges 21*a*, 22*a* are disposed on the right and left side portions of each of the upper and lower blades 21, 22 such that the flanges 21*a*, 22*a* extend from the rear end to the substantially central position of the slider body. In this slider body 2, a Y-shaped element guide passage 24 is formed between the upper and lower blades 21 and 22, and the slider body 2 also has a rear mouth 25 at its rear end and two shoulder mouths at its front end.

The slider body 2 has a pawl support portion 27 erected on the front portion of the upper face of the upper blade 21. The pawl support portion 27 has right and left wall portions 27*a*, 27*b* which are disposed apart from each other with a gap allowing the locking pawl body 6 to be fitted and a front wall portion 27*c* for connecting the front end sides of these right and left wall portions 27*a*, 27*b*. A pivotally supporting convex portion 27*d* for supporting the locking pawl body 6 such that the locking pawl body 6 can swing up and down is formed between the right and left wall portions 27*a*, 27*b*.

Further, the slider body 2 has a fitting portion 28*a* and flange sliding grooves 28*b*. The fitting portion 28*a* is provided concavely forward of the pawl support portion 27 of the upper blade 21, and allows a front end side flange 32*a* described later of the pull tab holder body 3 to be fitted thereto. The flange sliding grooves 28*b* are provided concavely linearly along the length direction of the slider body 2 from the front end of the upper blade 21 up to the rear side of the right and left wall portions 27*a*, 27*b* of the pawl support portion 27.

The flange sliding groove 28*b* is provided concavely downwardly from the top face of the upper blade 21, and the bottom face side thereof on the fitting portion 28*a* is formed to be bent at right angle with respect to outward in the width direction of the slider body 2 so that the right and left flanges 35*b* of the slider body 2 can be fitted thereto. As shown in FIG. 8, protruded portions 28*c* for caulking which are protruded into a triangular shape in its section are provided on the top face of the upper blade 21 along the flange sliding grooves 28*b*.

Further, the slider body 2 contains a pawl hole 30 which penetrates the element guide passage 24 from the top face of the upper blade 21, backward of the pawl support portion 27. An opening/closing member guide groove 29 on which the opening/closing member 4 is to be fitted and slid in the length direction is formed in the top face of the upper blade 21 in a forward direction from its rear end. The opening/closing member guide groove 29 is provided up to right and left side portions of the pawl hole 30.

A spring loading groove 29*a* on which the coil spring 5 is to be loaded is formed in part of the bottom face of the opening/closing member guide groove 29. Projecting pieces 29*b* which project from the bottom face of the opening/closing member guide groove 29 are disposed on right and left sides of the rear end portion of the upper blade 21. The projecting piece 29*b* takes a role of a stopper for the opening/closing member 4 by bending the top end of the projecting piece 29*b* toward the central portion in the width direction of the slider body 2 with a pressure after the opening/closing member 4 is fitted to the opening/closing member guide groove 29.

The pull tab holder body 3 has a configuration curved downwardly in a substantially concave shape, and a space portion 34 is formed between right and left wall portions. The pull tab holder body 3 is attached in a cantilevered state in the length direction of the slider body 2 such that one end thereof (fixing side proximal portion 31) is fixed to the front portion of the top face of the upper blade 21 while a gap 33 is formed between the other end portion (rear end portion 32) and the slider body 2. As shown in FIG. 2, engaging portions 36 are provided on the front and rear portions of an upper face inside the pull tab holder body 3. By engaging a cutout portion 7*a* formed in the front and rear of the leaf spring 7 on each of the engaging portions 36, the leaf spring 7 is mounted in the space portion 34 of the pull tab holder body 3.

The fixing side proximal portion 31 of the pull tab holder body 3 is formed wide in the longitudinal direction (length direction). A front side flange 35*a* which is fitted to the fitting portion 28*a* of the slider body 2 is disposed on the front face portion of the fixing side proximal portion 31, while the right and left flanges 35*b* which are fitted to the flange sliding grooves 28*b* in the slider body 2 and slid are disposed on right and left side surfaces of the fixing side proximal portion 31. The right and left flanges 35*b* are formed thinner than the front side flange 35*a*. On the other hand, a recess portion 37 and an accommodating portion 38 are formed in right and left side surfaces on the side of the rear end portion 32 of the pull tab holder body 3 such that they face downwardly in a concave shape opposing the slider body 2. A continuous edge portion 39 is disposed between the recess portion 37 and the accommodating portion 38.

The opening/closing member 4 is formed in a substantially U shape in its plan view not to interfere with the pawl hole 30 when the opening/closing member 4 is mounted on the upper blade 21 of the slider body 2 and slid. The opening/closing member 4 has guide portions 43 which are fitted to the opening/closing member guide groove 29 in the upper blade 21 slidably at the bottoms of right and left side edges thereof. A first closing portion 41 and a second closing portion 42 are disposed on the proximal end side and front end side of each of two-forked arm portions of the opening/closing member 4.

The locking pawl body 6 has a pawl proximal portion 61, and an upper arm portion 62 and a lower arm portion 63 extending substantially in parallel such the upper and lower arm portions 62, 63 are branched to two sections from the pawl proximal portion 61. A pawl portion 64 projecting into the element guide passage 24 through the pawl hole 30 in the slider body 2 is formed at the front end of the lower arm portion 63. An operating concave groove 65 which is open to the rear mouth 25 side of the slider body 2 is provided between the upper and lower arm portions 62 and 63. The pawl proximal portion 61 has a pivotally supporting concave portion 66 which is supported by the pivotally supporting convex portion 27*d* of the pawl support portion 27.

The pull tab 8 is formed of a strip-like sheet material. An annular portion 11, in which the pull tab holder body 3 is to be inserted, is formed on one end side of the pull tab 8, and a grip portion 12 is formed to extend toward the other end side form the annular portion 11. A shaft portion 13 having a circular section is disposed at the front end portion of the annular portion 11. The length of the shaft portion 13 is set larger than the width dimension of the pull tab holder body 3.

Next, the procedure for assembling the slide fastener slider 1 of the first embodiment will be described.

First, a process for assembling the opening/closing member 4 and the coil spring 5 onto the slider body 2 is carried out. More specifically, the coil spring 5 is loaded into the spring loading groove 29*a* formed in the upper blade 21 of the slider body 2, and then, the guide portions 43 of the opening/closing member 4 are fitted into the opening/closing member guide groove 29 in the upper blade 21 so as to push the opening/closing member 4 into the upper blade 21 from its rear end side until it is fitted thereto. With the coil spring 5 contracted by pushing the opening/closing member 4 forward of the upper blade 21, the projecting pieces 29*b* disposed on both sides of an entrance of the opening/closing member guide groove 29 are bent toward the central portion in the width direction of the slider body 2 with a pressure.

Consequently, the opening/closing member 4 and the coil spring 5 are installed undetachably to the upper blade 21 of the slider body 2. The opening/closing member 4 is attached to the slider body 2 slidably along the spring loading groove 29*a* such that the opening/closing member 4 is always urged backward by the coil spring 5 because the coil spring 5 is interposed between the opening/closing member 4 and the upper blade 21 in the length of the slider body 2.

Figure 3:
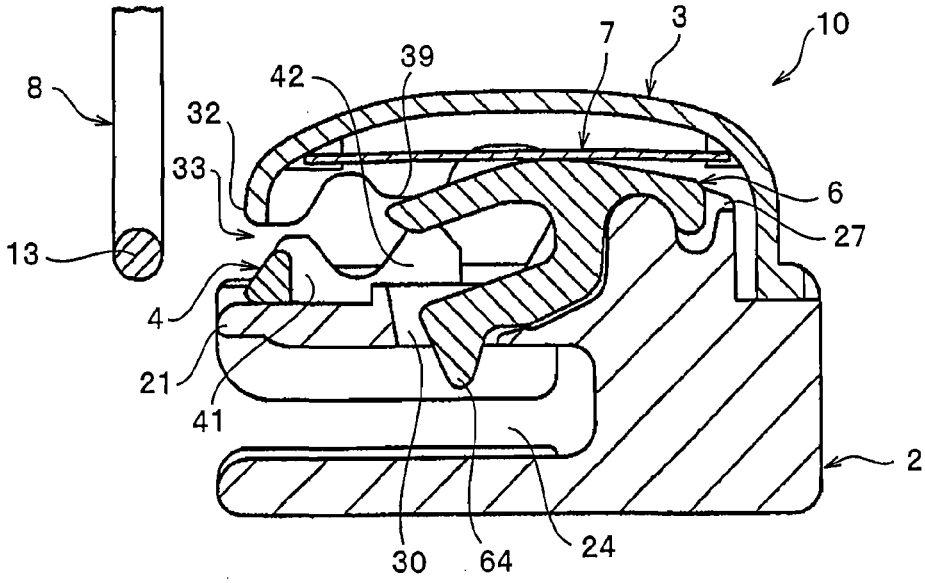
FIG. 3 is a longitudinal sectional view showing a primary assembly of the slider of the first embodiment.

Next, a process for assembling the locking pawl 6, the pull tab holder body 3 and the leaf spring 7 to the slider body 2 equipped with the opening/closing member 4 and the coil spring 5 is carried out. First, as shown in FIG. 2, the locking pawl body 6 is fitted to the pawl support portion 27 on the slider body 2 from above, and by placing the pivotally supporting concave portion 66 in the locking pawl body 6 on the pivotally supporting convex portion 27*c* of the pawl support portion 27, the locking pawl body 6 is supported so as to be swingable vertically. On the other hand, the leaf spring 7 is mounted inside the space portion 34 of the pull tab holder body 3. Subsequently, the right and left flanges 35*b* of the pull tab holder body 3 are fitted to the flange sliding groove 28*b* from the front end of the slider body 2 and further, the pull tab holder body 3 is slid backward of the slider body 2 along the flange sliding groove 28*b*. Consequently, the pull tab holder body 3 including the leaf spring 7 is assembled to the slider body 2, so that the primary assembly 10 shown in FIG. 3 is obtained.

Thereafter, the protruded portion 28*c* (see FIG. 8) for caulking provided on the slider body 2 is crushed from the top face side of the upper blade 21 by means of a punch or the like so as to fix the right and left flanges 35*b* of the pull tab holder body 3 to the upper blade 21 by caulking. Consequently, the pull tab holder body 3 can be fixed firmly so as to be prevented from slipping out of the slider body 2.

In the primary assembly 10 obtained in this way, the locking pawl 6 fitted to the pawl support portion 27 of the slider body 2 presses the leaf spring 7 downward. Consequently, the pawl portion 64 of the locking pawl body 6 is projected into the element guide passage 24 through the pawl hole 30. Further, the opening/closing member 4 is urged backward by the coil spring 5. With this configuration, the gap 33 formed between the rear end portion 32 of the pull tab holder body 3 and the upper blade 21 of the slider body 2 is closed by the first closing portion 41 of the opening/closing member 4, and a gap formed between the continuous edge portion 39 of the pull tab holder body 3 and the upper blade 21 is also closed by the second closing portion 42 of the opening/closing member 4. Hereinafter, the position of the opening/closing member 4 in such a state is called gap closing position.

Figure 4:
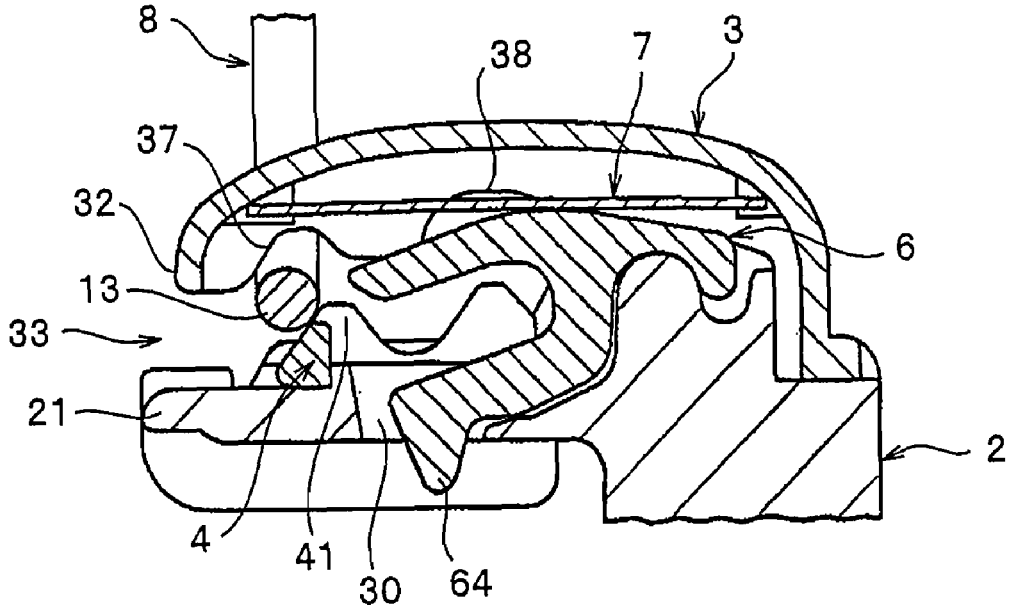
FIG. 4 is a longitudinal sectional view for explaining the procedure for moving a shaft portion of a pull tab into a recess portion in the pull tab holding portion by sliding an opening/closing member.
Figure 5:
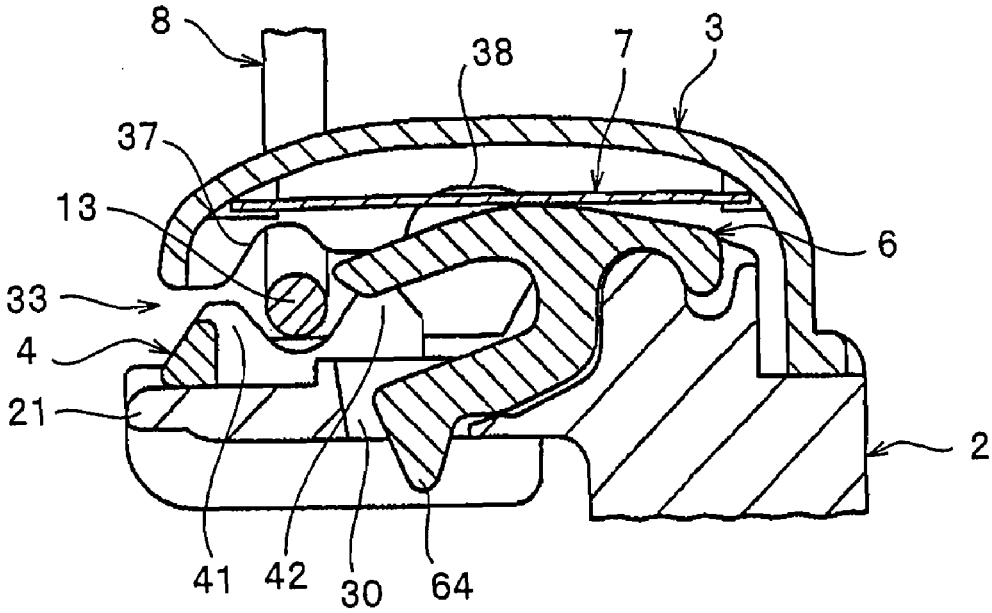
FIG. 5 is a longitudinal sectional view for explaining a state in which with the shaft portion of the pull tab moved into the recess portion of the pull tab holder body, the opening/closing member is returned to a gap closing position.

To attach the pull tab 8 to the primary assembly 10, first, the shaft portion 13 of the pull tab 8 is pressed into the gap 33 from rear end side of the primary assembly 10. Consequently, as shown in FIG. 4, the opening/closing member 4 is slid forward resisting an urging force of the coil spring 5 along the opening/closing member guide groove 29 in the upper blade 21 so as to open the gap 33. As a result, the shaft portion 13 of the pull tab 8 passes through the gap 33 and is introduced by an inclined face of the first closing portion 41 of the opening/closing member 4 and moved into the recess portion 37 in the pull tab holder body 3. Then, if the shaft portion 13 of the pull tab 8 is moved into the recess portion 37, the opening/closing member 4 pushed forward by the shaft portion 13 is urged by the coil spring 5 and returned to the gap closing position as shown in FIG. 5 so as to close the gap 33.

Thereafter, the shaft portion 13 of the pull tab 8 accommodated in the recess portion 37 in the pull tab holder body 3 is moved downward and then pushed forward of the slider body 2. Consequently, as shown in FIG. 6, the opening/closing member 4 is slid forward resisting the urging force of the coil spring 5 along the opening/closing member guide groove 29 in the upper blade 21, so that the gap formed between the continuous edge portion 39 of the pull tab holder body 3 and the upper blade 21 is opened. Then, the shaft portion 13 of the pull tab 8 is moved from the recess portion 37 in the pull tab holder body 3 to the accommodating portion 38 side through the opened gap. At this time, the shaft portion 13 of the pull tab 8 is guided in between the arm portions 62 and 63 of the locking pawl body 6 and introduced into the operating concave groove 65.

Then, the shaft portion 13 of the pull tab 8 is moved to the accommodating portion 38 side and further moved into the accommodating portion 38 by being introduced by the inclined face of the second closing portion 42 of the opening/closing member 4. In this event, the opening/closing member 4 pushed forward is returned to the gap closing position by being urged by the coil spring 5 as shown in FIG. 7, because interference between the shaft portion 13 of the pull tab 8 and the second closing portion 42 of the opening/closing member 4 is eliminated. Consequently, the pull tab 8 is attached completely to the primary assembly 10, so that the slide fastener slider 1 of the first embodiment shown in FIG. 10 is obtained.

On the other hand, to remove the pull tab 8 from the primary assembly 10 in the slider 1 of the first embodiment, the opening/closing member 4 is moved forward resisting the urging force of the coil spring 5 so as to open the gap formed between the continuous edge portion 39 of the pull tab holder body 3 and the upper blade 21 and the gap formed between the rear end portion 32 of the pull tab holder body 3 and the upper blade 21. Then, the pull tab 8 is moved gradually step by step in an inverse procedure to the procedure shown in FIGS. 3 to 7. This enables the pull tab 8 to be removed easily. Further, moving a new type pull tab different from the pull tab 8 following the procedure shown in FIGS. 3 to 7 makes it possible to attach the new pull tab to the primary assembly 10 easily.

As described above, the slider 1 of the first embodiment enables the pull tab 8 to be detachably attached thereto. Also the slider 1 is equipped with the automatic stop mechanism which automatically stops the sliding of the slider 1 with respect to the fastener element row passing through the element guide passage 24 because the locking pawl body 6 attached to the slider body 2 is urged by the leaf spring 9 so that the pawl portion 64 is projected into the element guide passage 24.

In the slider 1 of the first embodiment, the locking pawl body 6 is fitted to the pawl support portion 27 of the slider body 2. In addition, the flange sliding groove 28*b* formed in the slider body 2 and the right and left flanges 35*b* formed on the pull tab holder body 3 constitute a fitting sliding structure in which the pull tab holder body 3 is fitted from the front end of the slider body 2 and slid backward. The pull tab holder body 3 is fixed to the slider body 2 under the fitting sliding structure. Consequently, the slider 1 of the first embodiment enables the primary assembly 10 (slider 1) to be assembled easily without using any pin inserted in the right and left direction like the slider which allows the pull tab to be attached thereto or detached therefrom, described in the Japanese Utility Model Publication No. 4-32974.

Consequently, when executing the assembly work of the slider 1 using, for example, the continuous assembly apparatus equipped with the turn table, the primary assembly 10 can be assembled by supplying respective components such as the pull tab holder body 3 in the longitudinal direction and in the vertical direction of the slider body 2. Therefore, the continuous assembly apparatus does not need to be equipped with a mechanism movable in the right and left direction (peripheral direction of the turn table) with respect to the slider body 2 held by the turn table or include any expanded space in the peripheral direction of the turn table. Such a configuration prevents the continuous assembly apparatus from being enlarged in size and enables effective assembly of the slider under an excellent productivity.

On the other hand, if the assembly work of the slider 1 is carried out manually, the assembly work can be carried out easily and effectively by omitting a complicated work of inserting a pin from sideways ever seen in the conventional way, whereby the productivity of the slider can be improved.

Further, the slider 1 of the first embodiment does not need to have a shaft hole or pin hole penetrating the slider body 2 or the pull tab holder body 3 in the right and left direction. Thus, when manufacturing these components by molding, a mold structure having no slide core can be adopted thereby to easily constitute the mold structure. Further, the quantity of molded components such as the slider bodies and the pull tab holding bodies which can be obtained by a single molding can be increased, thereby enables reduction of manufacturing cost of the slider 1.

Figure 11:
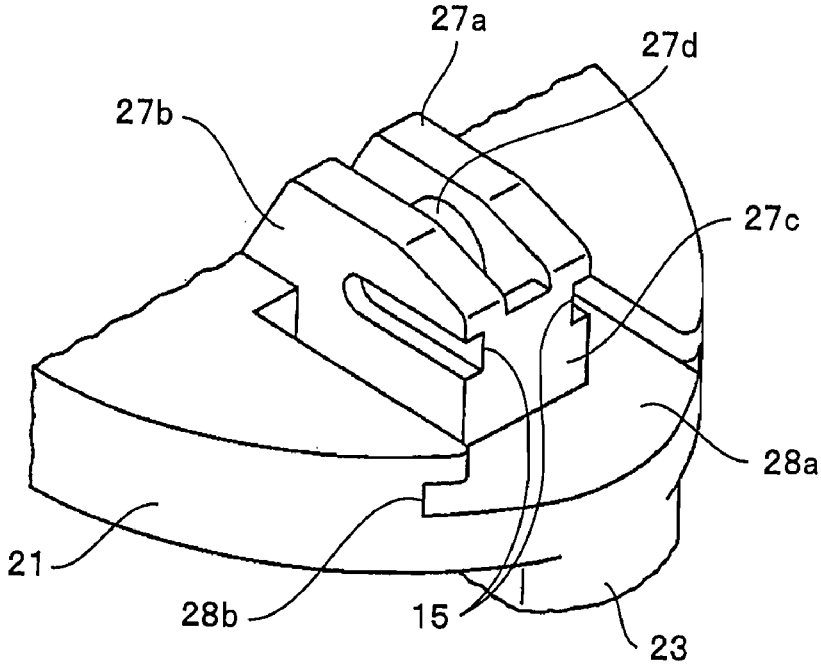
FIG. 11 is a perspective view of major portions showing a modification of fixing by caulking.

According to the slider 1 of the first embodiment, the pull tab holder body 3 is assembled from the front end of the slider body 2 through the fitting sliding structure as described previously, and then, the right and left flanges 35*b* of the pull tab holder body 3 are fixed to the upper blade 21 by caulking as shown in FIG. 9. However, in the present invention, the means for fixing the pull tab holder body by caulking is not restricted to this. For example, it is permissible to provide a groove 15 for fixing by caulking in each of the right and left wall portions 27*a*, 27*b* of the pawl support portion 27 of the slider body 2 as shown in FIG. 11.

Figure 12:
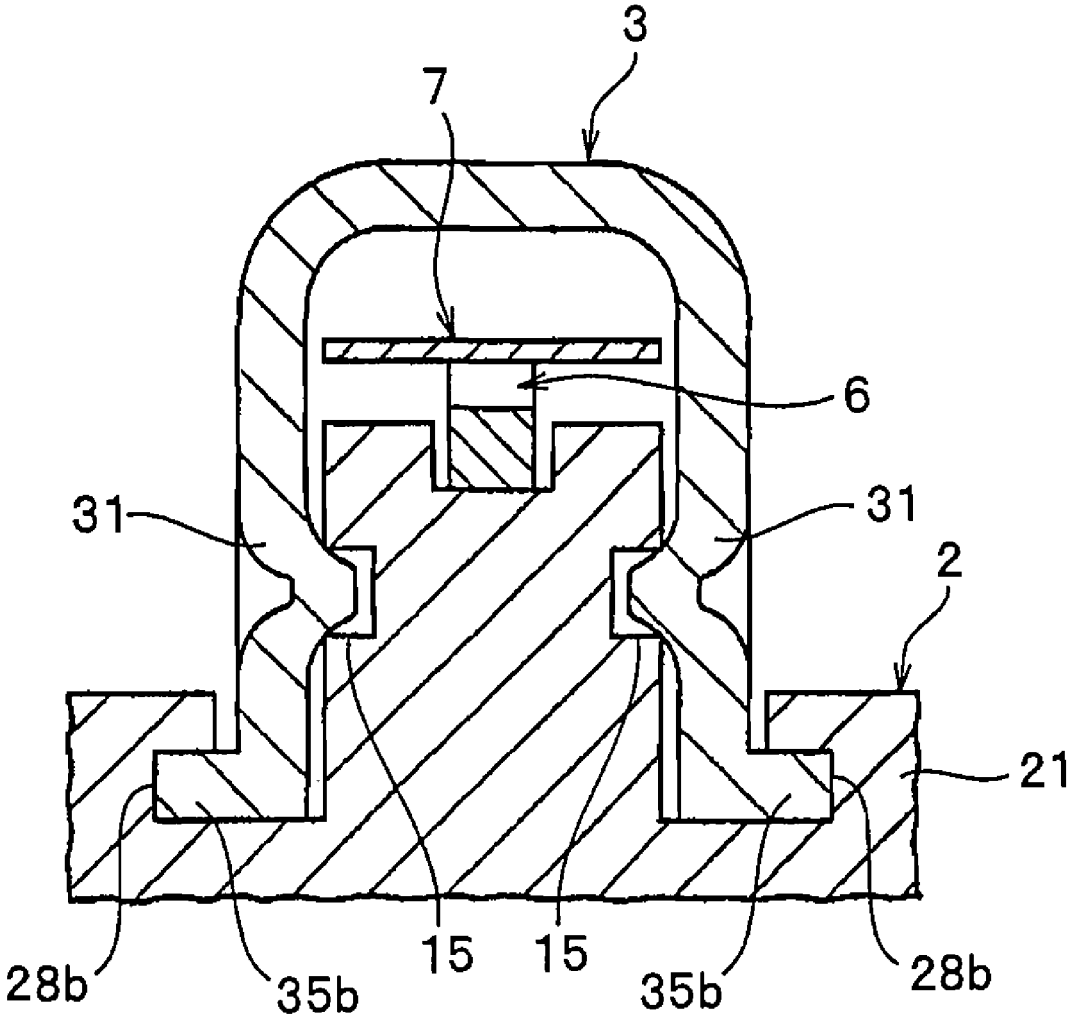
FIG. 12 is a major portion lateral sectional view showing the modification of fixing by caulking.

After the pull tab holder body 3 is assembled to the slider body 2 through the fitting sliding structure, by pressing the right and left side surfaces on the fixing side proximal portion 31 side of the pull tab holder body 3 from outside as shown in FIG. 12 so as to force part of the pull tab holder body 3 into the groove 15 for fixing by caulking, the pull tab holder body 3 may be fixed by caulking. If the pull tab holder body 3 can be fixed to the slider body 2 with a sufficient strength with the fitting sliding structure alone, that is, the right and left flanges 35*b* of the pull tab holder body 3 make firm contact with the flange sliding grooves 28*b* in the slider body 2, the fixing of the pull tab holder body 3 by caulking can be omitted.

Second Embodiment

Figure 13:
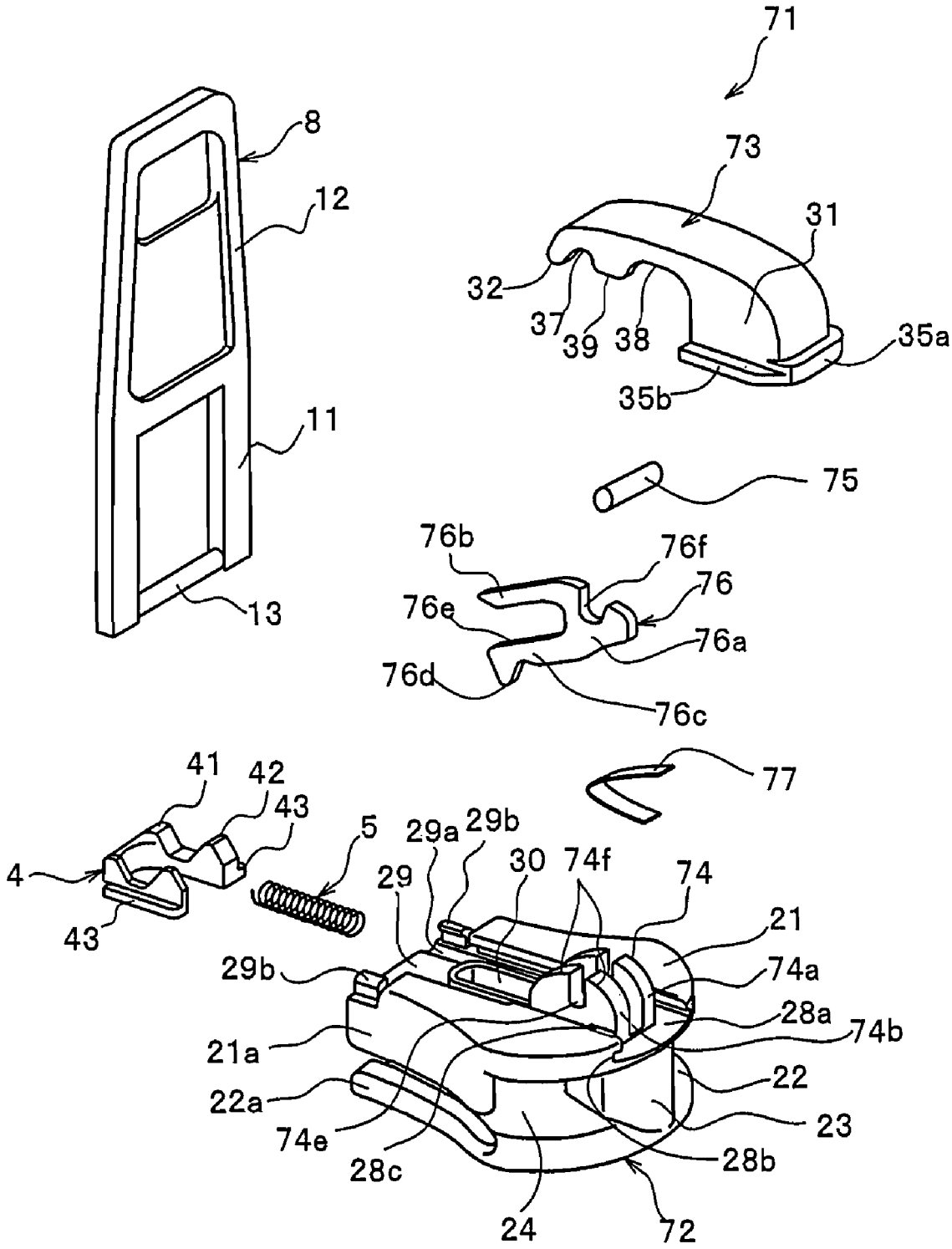
FIG. 13 is a perspective view showing a state in which components constituting a slide fastener slider according to a second embodiment of the present invention are disassembled.

FIGS. 13 to 18 show a slide fastener slider according to a second embodiment of the present invention. FIG. 13 is a perspective view showing a state in which components constituting the slide fastener slider are disassembled. FIGS. 14 to 18 are longitudinal sectional views showing the assembly procedure of the slider. In the meantime, in the second embodiment and a third embodiment described later, components and members having the same configuration as those of the first embodiment are expressed with like reference numerals, and description thereof is omitted for that reason.

A slide fastener slider 71 according to the second embodiment is comprised of a slider body 72, a pull tab holder body 73, the opening/closing member 4, the coil spring 5, a locking pawl body 76, a leaf spring 77 serving as urging means, a pivotally supporting pin 75 for supporting the locking pawl body 76 pivotally, and the pull tab 8.

A pawl body support portion 74 is provided projectingly on the front portion of the top face of the upper blade 21 of the slider body 72 of the second embodiment. The pawl body support portion 74 has right and left wall portions 74*a*, 74*b* disposed separately with an interval which allows the locking pawl body 76 to be fitted thereto. A placing surface 74*c* for the locking pawl body 76 is provided between the right and left wall portions 74*a* and 74*b*.

Figure 14:
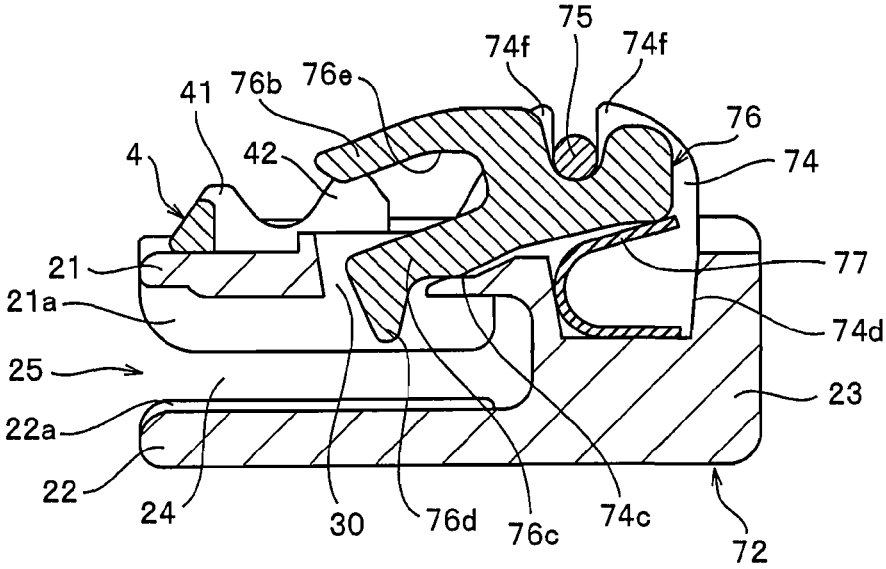
FIG. 14 is a longitudinal sectional view showing a state in which a locking pawl body is attached pivotally to a pawl support portion of a slider body.

A leaf spring accommodating hole 74*d* is provided in the connecting post 23 forward of the placing surface 74*c* as shown in FIG. 14, and the leaf spring 77 is accommodated in this leaf spring accommodating hole 74*d* such that the leaf spring 77 is bent so as to urge the locking pawl body 76. A fitting groove 74*e* for receiving the pivotally supporting pin 75 is provided in the center in the length direction of the right and left wall portions 74*a*, 74*b* of the pawl body support portion 74. Forward and rearward portions divided by the fitting groove 74*e* form pivotally supporting pin receiving portion 74*f*.

The pull tab holder body 73 excludes the engaging portion 36 which is means for mounting the leaf spring from the pull tab holder body 3 of the first embodiment. The pull tab holder body 73 has substantially the same configuration as the pull tab holder body 3 of the first embodiment (see FIG. 1) except the point mentioned above.

The locking pawl body 76 has a pawl proximal portion 76*a*, and an upper arm portion 76*b* and a lower arm portion 76*c* extending substantially in parallel such that the upper and lower arm portions 76*b*, 76*c* are branched to two sections from the pawl proximal portion 76*a*. A pawl portion 76*d* projecting into the element guide passage 24 through the pawl hole 30 in the slider body 72 is formed at the front end of the lower arm portion 76*c*. An operating concave groove 76*e* which is open to the rear mouth 25 side of the slider body 2 is provided between the upper and lower arm portions 76*b* and 76*c*. The pawl proximal portion 76*a* has a fitting concave portion 76*f* for receiving the pivotally supporting pin 75.

To assemble the slider 71 of the second embodiment having such components, first, the opening/closing member 4 and the coil spring 5 are assembled to the slider body 72 in the same procedure as the first embodiment, so that the opening/closing member 4 is attached slidably to the spring loading groove 29*a* in a state in which the opening/closing member 4 is always urged backward by the coil spring 5.

Next, as shown in FIG. 14, the leaf spring 77 is accommodated in the leaf spring accommodating hole 74*d* in the slider body 72 such that its bent portion is directed backward. Subsequently, the locking pawl body 76 is inserted in between the right and left wall portions 74*a*, 74*b* of the pawl body support portion 74 from above. With the fitting groove 74*e* in the pawl support portion 74 and the fitting concave portion 76*f* in the locking pawl body 76 aligned with each other, the locking pawl body 76 is placed on the placing surface 74*c*. Thereafter, the pivotally supporting pin 75 is inserted into the fitting groove 74*e* in the pawl body support portion 74 and the fitting concave portion 76*f* in the locking pawl body 76 from above. Further, the pair of pivotally supporting pin receiving portions 74*f* formed on the top face side of the right and left wall portions 74*a*, 74*b* are caulked to approach each other.

Consequently, both the right and left ends of the pivotally supporting pin 75 are fixed to the right and left wall portions 74*a*, 74*b*, so that the locking pawl body 76 is supported pivotally by the pawl body support portion 74 and the pivotally supporting pin 75 so as to be swingable vertically. At this time, the locking pawl body 76 is urged by the leaf spring 77 so as to project the pawl portion 76*d* into the element guide passage 24 through the pawl hole 30 in the slider body 72.

Figure 15:
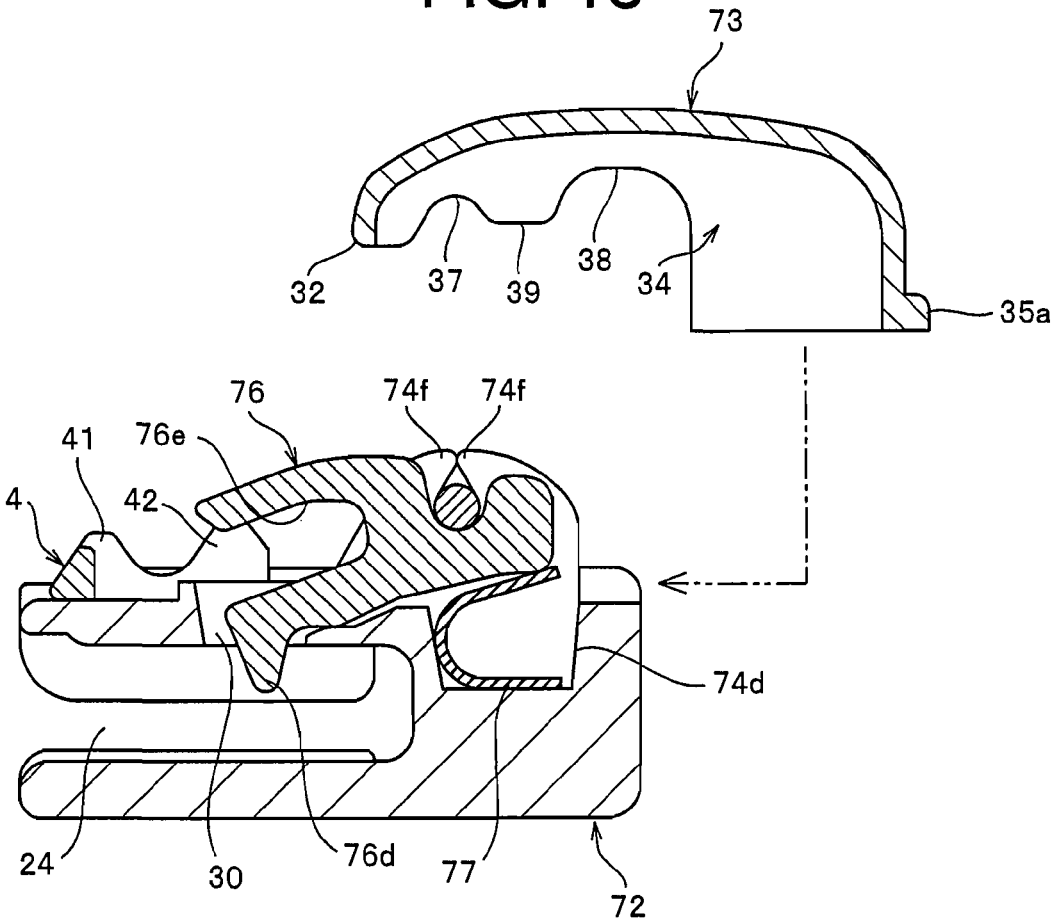
FIG. 15 is a longitudinal sectional view for explaining the procedure for fitting a pull holder body into the slider body by sliding.

After the locking pawl body 76 is fitted to the pawl body support portion 74, as shown in FIG. 15, the right and left flanges 35*b* of the pull tab holder body 73 are fitted to the flange sliding grooves 28*b* from the front end of the slider body 72, and the pull tab holder body 73 is slid backward of the slider body 72 along the flange sliding grooves 28*b*. According to the second embodiment, the fitting sliding structure is formed of the flange sliding grooves 28*b* formed in the slider body 72 and the right and left flanges 35*b* formed on the pull tab holder body 73, so that the fitting sliding structure enables the pull tab holder body 73 to be assembled to the slider body 72.

Figure 16:
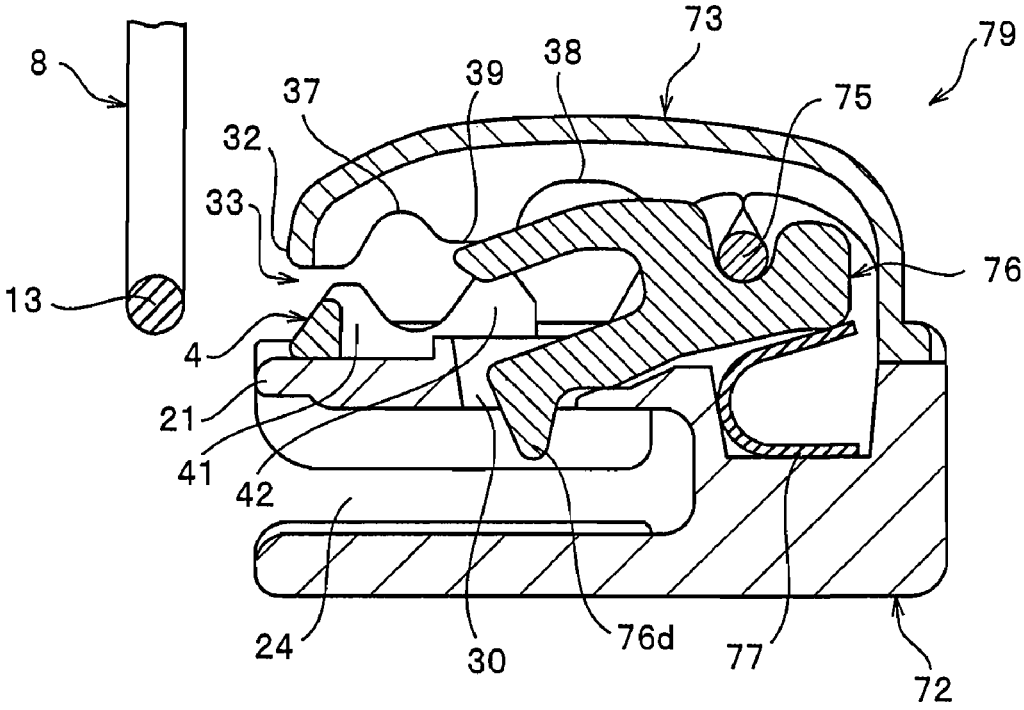
FIG. 16 is a longitudinal sectional view showing a primary assembly of the slider according to the second embodiment.

Thereafter, like the first embodiment, the protruded portion 28*c* for caulking provided on the slider body 72 is crushed from the top face side of the upper blade 21 so as to fix the right and left flanges 35*b* of the pull tab holder body 73 to the upper blade 21 by caulking, so that the pull tab holder body 73 is fixed stably. Consequently, the primary assembly 79 of the second embodiment is obtained as shown in FIG. 16.

To attach the pull tab 8 to the primary assembly 79, first, the shaft portion 13 of the pull tab 8 is pressed into the gap 33 formed between the rear end portion 32 of the pull tab holder body 73 and the upper blade 21. By doing so, the opening/closing member 4 is slid forward resisting the urging force of the coil spring 5 so as to open the gap 33. Consequently, the shaft portion 13 of the pull tab 8 is introduced to the recess portion 37 side through the gap 33. Then, if the shaft portion 13 of the pull tab 8 is moved into the recess portion 37, the opening/closing member 4 is urged by the coil spring 5 and returned to the gap closing position so as to close the gap 33.

Figure 17:
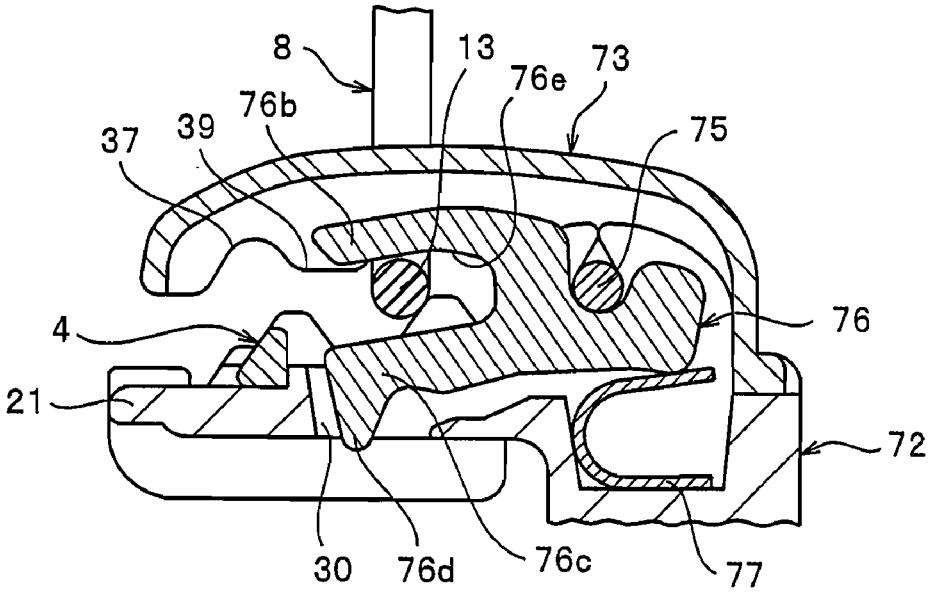
FIG. 17 is a longitudinal sectional view for explaining the procedure for moving a shaft portion of a pull tab into an accommodating portion of the pull tab holder body by sliding an opening/closing member.

Thereafter, the shaft portion 13 of the pull tab 8 accommodated in the recess portion 37 in the pull tab holder body 73 is pushed forward of the slider body 72. Consequently, as shown in FIG. 17, the opening/closing member 4 is slid forward resisting the urging force of the coil spring 5, so that the gap formed between the continuous edge portion 39 of the pull tab holder body 73 and the upper blade 21 is opened. Then, the shaft portion 13 of the pull tab 8 is moved from the recess portion 37 in the pull tab holder body 73 to the accommodating portion 38 side through the opened gap. At this time, the shaft portion 13 of the pull tab 8 is guided in between the upper and lower arm portions 76*b* and 76*c* of the locking pawl body 76 and introduced into the operating concave groove 76*e*.

Figure 18:
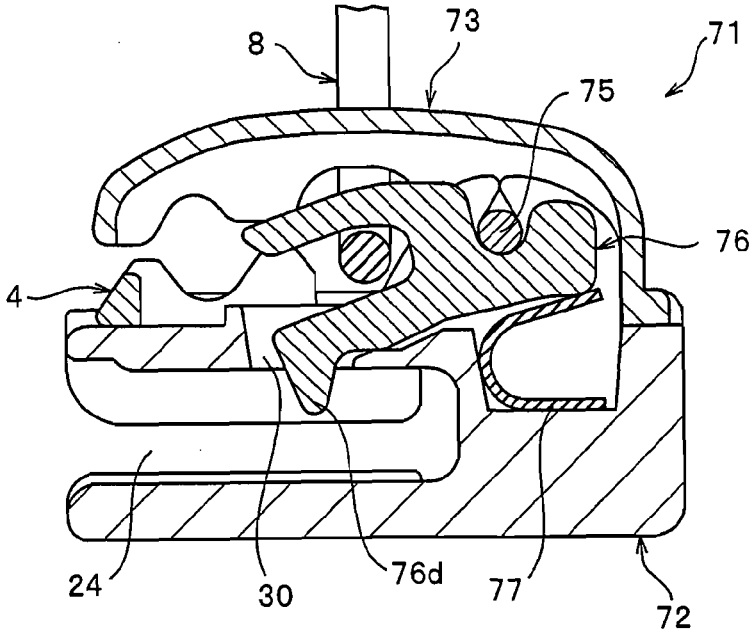
FIG. 18 is a longitudinal sectional view showing a state in which the shaft portion of the pull tab is moved into the accommodating portion of the pull tab holding portion so that the pull tab is attached.

Then, if the shaft portion 13 of the pull tab 8 is moved into the accommodating portion 38 side, the opening/closing member 4 pushed forward is returned to the gap closing position by being urged by the coil spring 5 as shown in FIG. 18, because interference between the shaft portion 13 of the pull tab 8 and the second closing portion 42 of the opening/closing member 4 is eliminated. Consequently the pull tab 8 is attached completely to the primary assembly 79, so that the slide fastener slider 71 of the second embodiment is obtained.

The slider 71 of the second embodiment enables the pull tab 8 to be detachably attached like the slider 1 of the first embodiment, and the slider 71 is equipped with an automatic stop mechanism which automatically stops the sliding of the slider 71 with respect to the fastener element row. Because the slider 71 allows the pull tab holder body 73 to be fixed to the slider body 72 under the fitting sliding structure, the primary assembly 79 can be assembled easily without use of any pin to be inserted from sideways. Further, it is not necessary to form the shaft hole or pin hole which penetrates the slider body 72 and the pull tab holder body 73 in the right and left direction, whereby the same effect as the first embodiment can be ensured.

Figure 19:
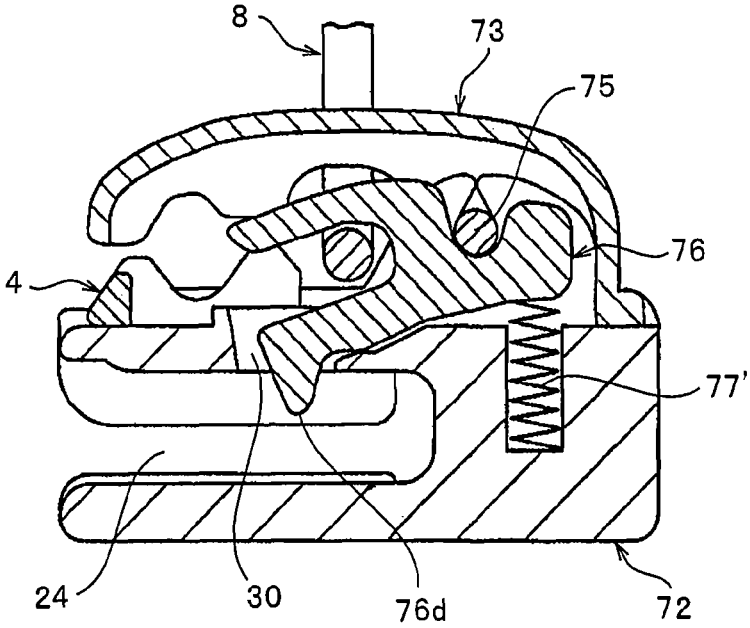
FIG. 19 is a longitudinal sectional view showing a modification of the slider according to the second embodiment.

In the meantime, the second embodiment allows a coil spring 77' as shown in FIG. 19 instead of the leaf spring 77 as the urging means for urging the locking pawl body 76. Although using the coil spring 77' enables the slider 71 to be equipped with the automatic stop mechanism, it is preferable to use the leaf spring 77 as the urging means because the leaf spring 77 is generally cheaper than the coil spring 77'.

Third Embodiment

Figure 20:
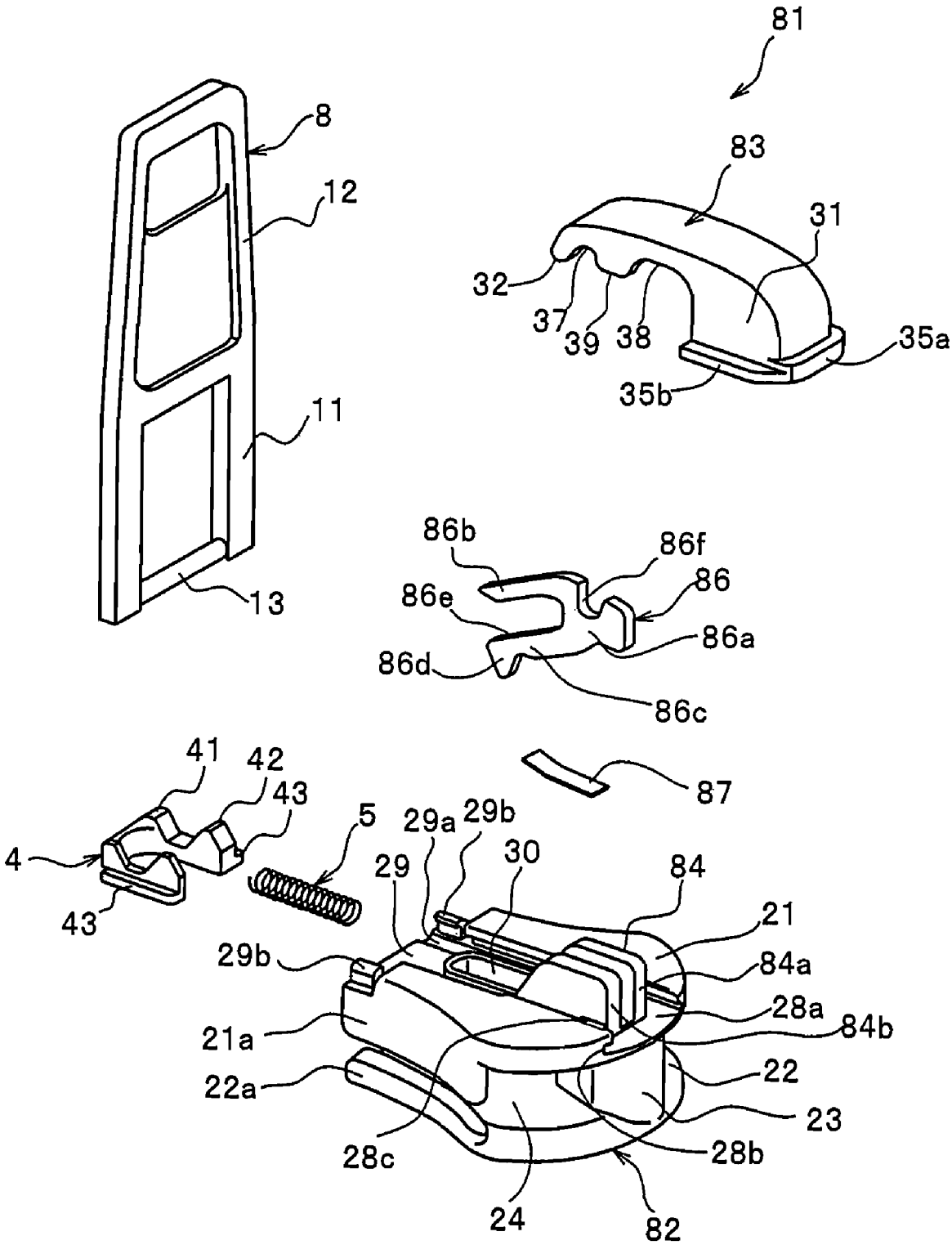
FIG. 20 is a perspective view showing a state in which components constituting a slide fastener slider according to a third embodiment of the present invention are disassembled.
Figure 21:
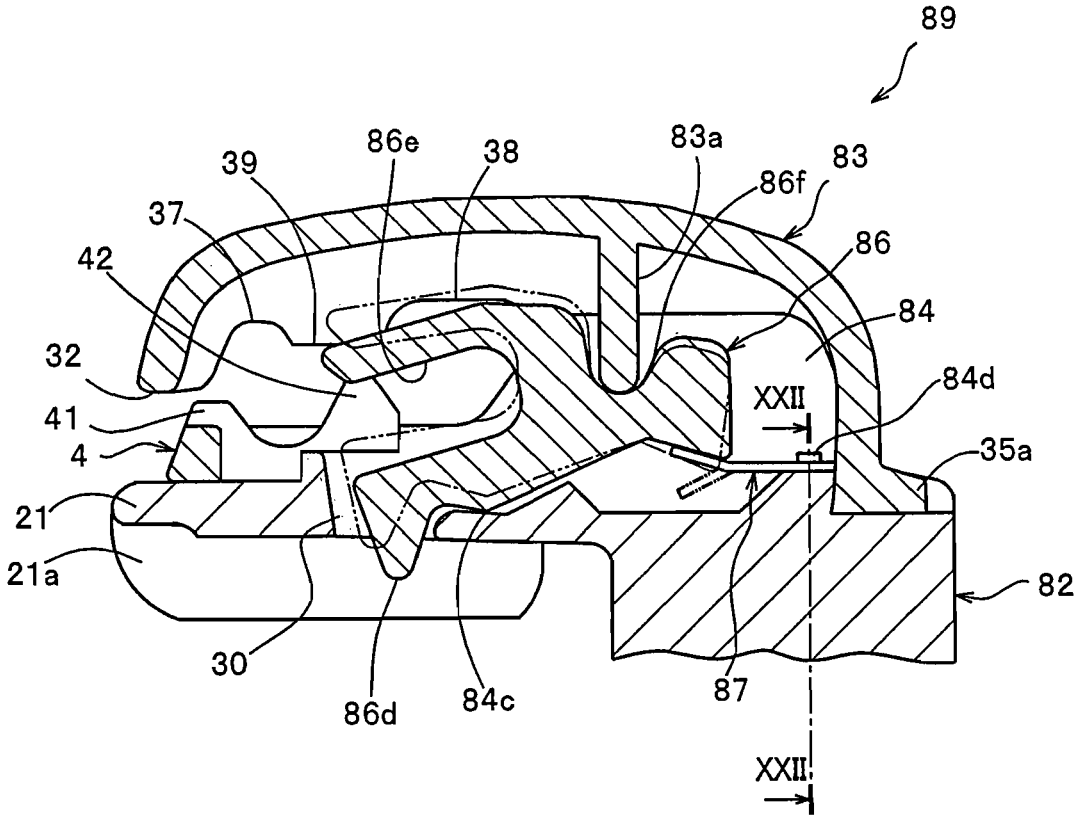
FIG. 21 is a longitudinal sectional view showing a primary assembly of the slider according to the third embodiment.
Figure 22:
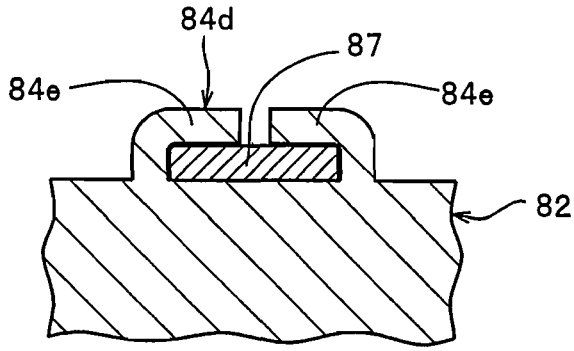
FIG. 22 is a sectional view taken along the line XXII-XXII in FIG. 21.

FIGS. 20 to 22 show a slide fastener slider according to a third embodiment of the present invention. FIG. 20 is a perspective view showing a state in which components constituting the slide fastener slider are disassembled, FIG. 21 is a longitudinal sectional view of major portions showing a primary assembly before a pull tab of the slider is attached, and FIG. 22 is a sectional view taken along the line XXII-XXII in FIG. 21.

A slide fastener slider 81 of the third embodiment is comprised of a slider body 82, a pull tab holder body 83, the opening/closing member 4, the coil spring 5, a locking pawl body 86, a leaf spring 87 as urging means, and the pull tab 8.

According to the third embodiment, the slider body 82 has a pawl support portion 84 provided projectingly on the front portion of the top face of the upper blade 21. The pawl support portion 84 has right and left wall portions 84*a*, 84*b* disposed separately with a gap which allows the locking pawl body 86 to be fitted thereto, and a placing surface 84*c* for the locking pawl body 86 is provided between the right and left wall portions 84*a*, 84*b*. A leaf spring fixing portion 84*d* is provided forward of the placing surface 84*c* as shown in FIG. 21. This leaf spring fixing portion 84*d* has right and left engaging pawls 84*e* as shown in FIG. 22, and the leaf spring 87 is fixed by the right and left engaging pawls 84*e* so as to be sandwiched thereby.

In this case, the leaf spring 87 is formed such that the rear end side thereof is bent upward, and a pawl body proximal portion 86*a* described later of the locking pawl body 86 is placed on the rear end side of the bent portion so as to urge the pawl body proximal portion 86*a* upward. In the meantime, as the urging means for urging the locking pawl body 86, it is permissible to use a flat leaf spring having no bent rear end, depending on the shape of the locking pawl body 86 and the shape of the placing surface 84*c* of the pawl body support portion 84.

The pull tab holder body 83 excludes the engaging portion 36 serving as means for mounting the leaf spring inside from the pull tab holder body 3 of the first embodiment, and has a projecting portion 83*a* provided to descend from a top face inside toward an insertion concave portion 86*f* described later of the locking pawl body 86 while it has substantially the same configuration as the pull tab holder body 3 of the first embodiment except the above-mentioned matter.

The locking pawl body 86 has a pawl proximal portion 86*a*, and an upper arm portion 86*b* and a lower arm portion 86*c* extending substantially in parallel such that the upper and lower arm portions 86*b*, 86*c* are branched to two sections from the pawl proximal portion 86*a*. A pawl portion 86*d* projecting into the element guide passage 24 through the pawl hole 30 in the slider body 82 is formed at the front end of the lower arm portion 86*c*. An operating concave groove 86*e* which is open to the rear mouth 25 side of the slider body 2 is provided between the upper and lower arm portions 86*b* and 86*c*. The pawl proximal portion 86*a* has an insertion concave portion 86*f* for receiving the projecting portion 83*a* of the pull tab holder body 83.

To assemble the slider 81 of the third embodiment having such components, first, the opening/closing member 4 and the coil spring 5 are attached to the slider body 82 in the same procedure as in the first embodiment, so that the opening/closing member 4 is attached slidably along the spring loading groove 29*a* in a state in which the opening/closing member 4 is always urged backward by the coil spring 5.

Next, the front end portion of the leaf spring 87 is fixed to the leaf spring fixing portion 84*d* of the pawl body support portion 84 by means of the engaging pawls 84*e*. Then, the locking pawl body 86 is fitted in between the right and left wall portions 84*a*, 84*b* of the pawl body support portion 84 by being inserted from above, so that the pawl body proximal portion 86*a* is placed on the rear end side of the leaf spring 87. At this time, the lower arm portion 86*c* of the locking pawl body 86 is placed on the placing surface 84*c* of the pawl body support portion 84, and the pawl body 86*d* is inserted into the pawl hole 30 in the slider body 82.

After the locking pawl body 86 is fitted to the pawl body support portion 84, the right and left flanges 35*b* of the pull tab holder body 83 are fitted to the flange sliding grooves 28*b* from the front end of the slider body 82, and the pull tab holder body 83 is slid backward of the slider body 82 along the flange sliding grooves 28*b*. According to the third embodiment, the fitting sliding structure is formed of the flange sliding grooves 28*b* formed in the slider body 82 and the right and left flanges 35*b* formed on the pull tab holder body 83, and this fitting sliding structure enables the pull tab holder body 83 to be assembled to the slider body 82.

When the right and left flanges 35*b* of the pull tab holder body 83 are fitted to the flange sliding groove 28*b* and slid therein, the pawl body proximal portion 86*a* of the locking pawl body 86 is pressed downward by the front end of the projecting portion 83*a* of the pull tab holder body 83 resisting the urging force of the leaf spring 87 and the front end of the projecting portion 83*a* is slid on the top face of the pawl body proximal portion 86*a* of the locking pawl body 86. Further, when the pull tab holder body 83 is slid up to the rear end position of the flange sliding groove 28*b*, the projecting portion 83*a* is inserted into the insertion concave portion 86*f* in the locking pawl body 86 while the elastic deformation of the leaf spring 87 is restored.

When the pull tab holder body 83 is assembled to the slider body 82, the locking pawl body 86 is supported pivotally by the pawl body support portion 84 and the projecting portion 83*a* of the pull tab holding portion 83 so as to be swingable vertically. At this time, the locking pawl body 86 is urged by the leaf spring 87, so that the pawl portion 86*d* is projected into the element guide passage 24 through the pawl hole 30 in the slider body 82.

Thereafter, like the first embodiment, the protruded portion 28*c* for caulking provided on the slider body 82 is crushed from the top face side of the upper blade 21 so as to fix the right and left flanges 35*b* of the pull tab holder body 73 to the upper blade 21 by caulking, so that the pull tab holder body 73 is fixed stably. Consequently, the primary assembly 89 of the third embodiment is obtained as shown in FIG. 21.

The shaft portion 13 of the pull tab 8 is moved gradually by sliding the opening/closing member 4 forward from the gap 33 formed between the rear end portion 32 of the pull tab holder body 83 and the upper blade 21 toward the accommodating portion 38 for the pull tab holder body 83 repeatedly like the first and second embodiments. Consequently, the pull tab 8 is attached to the primary assembly 89 so as to obtain the slide fastener slider 81 of the third embodiment.

The slider 81 of the third embodiment enables the pull tab 8 to be detachably attached like the first and second embodiments, and is equipped with an automatic stop mechanism which automatically stops the sliding of the slider 81 with respect to the fastener element row. The slider 81 allows the pull tab holder body 83 to be fixed to the slider body 72 under the fitting sliding structure. With this configuration, the primary assembly 89 can be assembled easily without use of any pinto be inserted from sideways and further, it is not necessary to form the shaft hole or pin hole in the slider body 82 and the pull tab holder body 83.

The present invention is not restricted to the first to third embodiments described above but may be modified in various ways, as long as substantially the same configuration as the present invention is possessed and the same operation and effects are achieved. In the first to third embodiments, the fitting sliding structure in which the pull tab holder body is fitted to the slider body and slid therein is formed of the right and left flanges formed on the fixing side proximal portion of the pull tab holder body and the flange sliding grooves formed from the front end of the upper blade of the slider body. However, the present invention is not restricted to this.

Figure 23:
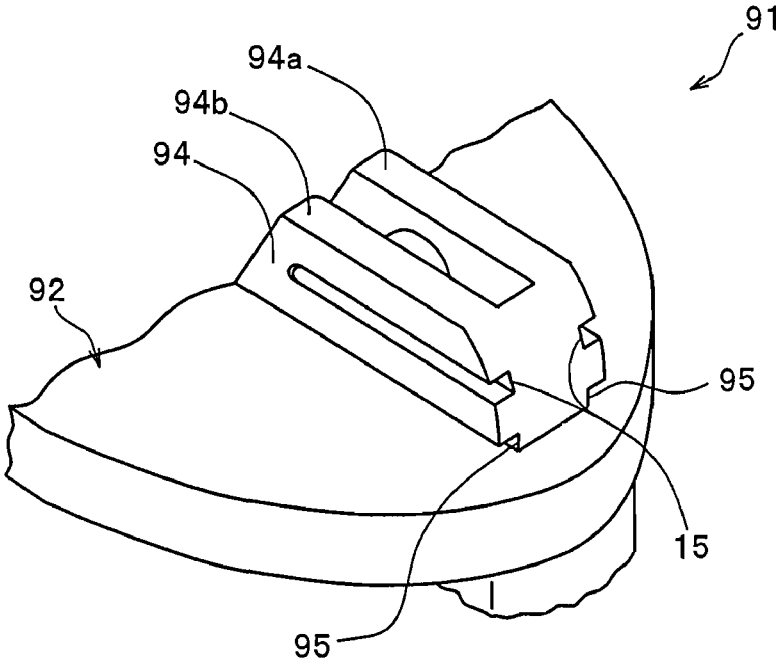
FIG. 23 is a perspective view of major portions for explaining a modification of a fitting sliding structure of the present invention.
Figure 24:
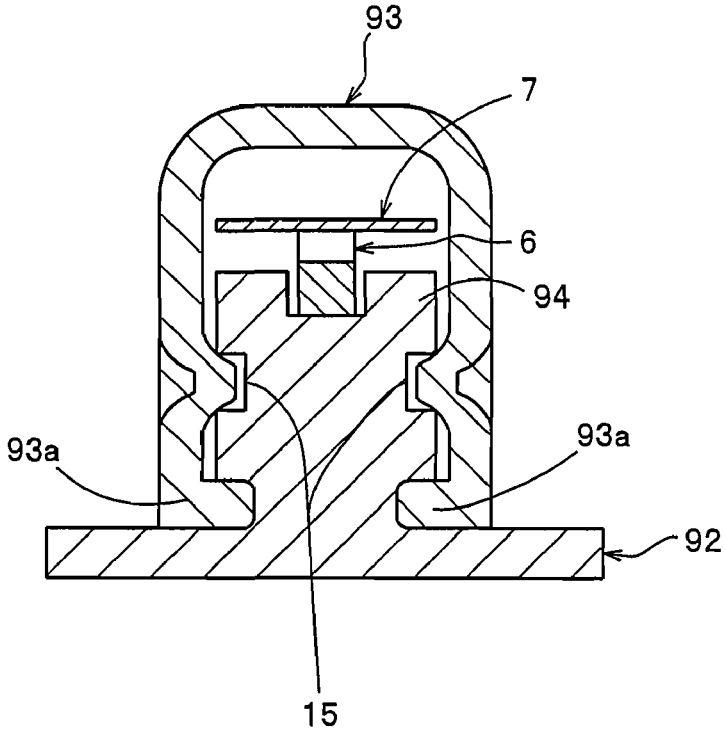
FIG. 24 is a lateral sectional view of major portions for explaining the same modification.

For example, like a slide fastener slider 91 shown in FIGS. 23 and 24, the fitting sliding structure may be formed by providing flanges 93*a* extending inward of the pull tab holder body 93 from right and left side edges of the proximal end on the fixing side of the pull tab holder body 93, and flange sliding grooves 95 which allow the flanges 93*a* to be fitted to the proximal portions of the pawl body support portion 94 of the slider body 92 and slid therein. By forming such a fitting sliding structure, the assembly of the slider 91 can be carried out easily without use of any pin to be inserted form sideways.

In this case, it is permissible to provide the groove 15 for fixing by caulking in the right and left wall portions 94*a*, 94*b* of the pawl support portion 94 of the slider body 92. After the pull tab holder body 93 is assembled to the slider body 92 through the fitting sliding structure, pressing right and left side surfaces of the pull tab holder body 93 from outside as shown in FIG. 24 so as to force part of the pull tab holder body 93 into the groove 15 for fixing by caulking in order to fix the pull tab holder body 93 by caulking.

In the first to third embodiments, description has been given to the fitting sliding structure in which the pull tab holder body is assembled to the slider body by being fitted from the front end of the slider body and slid. However, it is permissible to construct the fitting sliding structure by forming the flange sliding groove from the rear end of the slider body and fitting the pull tab holder body from the rear end of the slider body and sliding forward.

Figure 25:
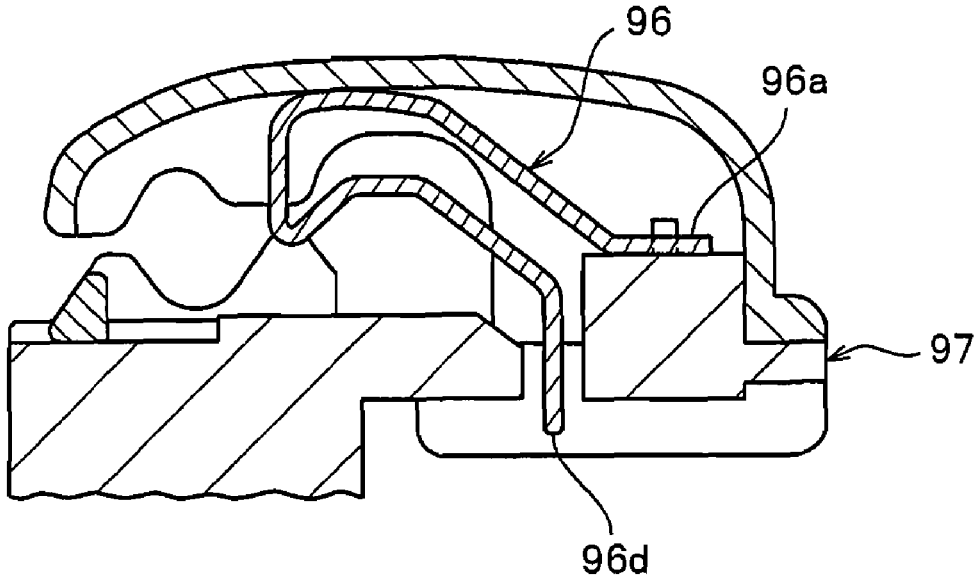
FIG. 25 is a longitudinal sectional view of major portions showing another modification of the slide fastener slider of the present invention.

In the first to third embodiments, the leaf spring serving as the urging means for the locking pawl body is provided separately from the locking pawl body, and the leaf spring is disposed on the pull tab holder body or the slider body to urge the locking pawl body. However, according to the present invention, as shown in FIG. 25, it is permissible to form a locking pawl body 96 with a leaf spring bent into a predetermined shape so as to integrate the urging means with the locking pawl body 96 and fix the proximal portion 96*a* of the locking pawl body 96 to the slider body 97 so that the pawl portion 96*d* of this locking pawl body 96 projects into the element guide passage, thereby achieving the automatic stop mechanism.

Figure 26:
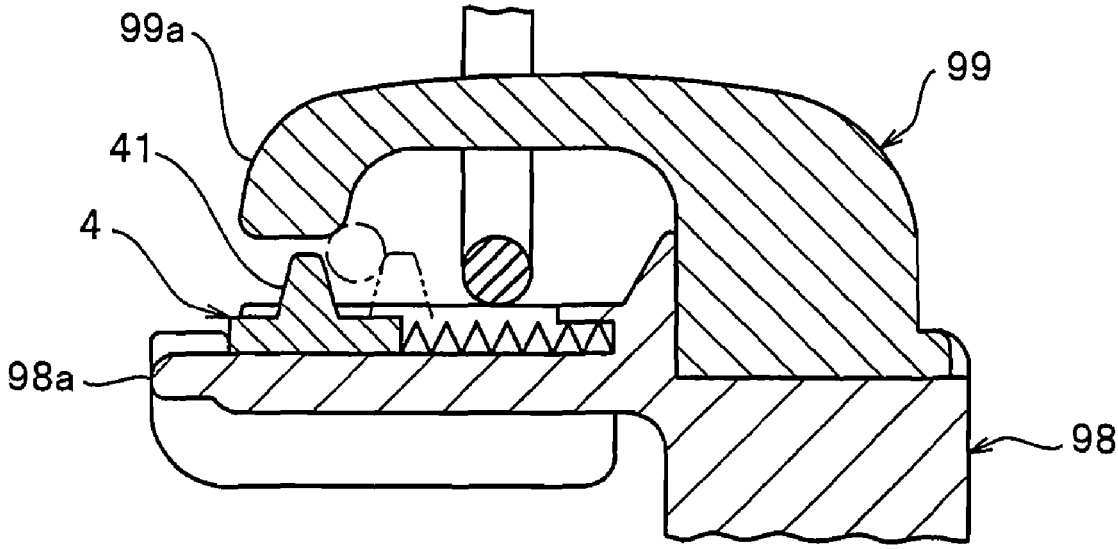
FIG. 26 is a longitudinal sectional view of major portions showing still another modification of the slide fastener slider of the present invention.

Further, according to the first to third embodiments, the fitting sliding structure is provided between the slider body and the pull tab holder body in the slider having the automatic stop mechanism, that is, the locking pawl body. However, the present invention can adopt the fitting sliding structure to a slider having no locking pawl body. For example, as shown in FIG. 26, the slider body 98 has no pawl body support portion for supporting the locking pawl body or no pawl hole which allows the pawl body of the locking pawl body to project into the element guide passage. Further, the pull tab holder body 99 maybe formed in a solid body having no space for accommodating the locking pawl body and the pawl body support portion inside and the fitting sliding structure may be provided between the slider body 98 and the pull tab holder body 99. The closing member 4 capable of opening/closing a gap between an upper blade 98*a* and a rear end portion 99*a* is disposed between the upper blade 98*a* of the slider body 98 and the rear end portion 99*a* of the pull tab holder body 99. The opening/closing member 4 has a single closing portion 41 and disposed slidably between a gap closing position and a gap opening position of the upper blade 98*a*.

What is claimed is:

1. A slide fastener slider comprising:

a slider body having an upper blade and a lower blade which are connected through a connecting post disposed on front ends of the upper and lower blades, and having a rear mouth at a rear end of the slider body;

a pull tab holder body which is attached to the slider body in a cantilevered state with one end portion thereof fixed to a top face side of the slider body;

an opening/closing member which is disposed slidably on the slider body so as to open and close a gap formed between a second end portion of the pull tab holder body and the upper blade; and an elastic member for urging the opening/closing member to close the gap, the opening/closing member resisting an urging of the elastic member to open the gap, so that the pull tab is inserted or removed through the gap when the gap is opened, whereby the pull tab is detachably held between the slider body and the pull tab holder body, wherein the slide fastener slider further comprises a fitting sliding structure in which the pull tab holder body is fitted to the slider body from a front end or a rear end thereof so as to be relatively slidable in a length direction of the slider body;

wherein the fitting sliding structure includes:

flanges which are formed along a length direction of one of the slider body or the pull tab holder body; and flange sliding grooves which are formed along a length direction of the other one of the slider body or the pull tab holder body to allow the flanges to be fitted thereto and slid thereon.

2. The slide fastener slider according to claim 1, wherein the flanges are disposed on right and left side surfaces of the one end portion of the pull tab holder body, and the flange sliding grooves are disposed at a front end portion or a rear end portion of the upper blade of the slider body.

3. The slide fastener slider according to claim 1, wherein the slider comprises a locking pawl body having a proximal portion, an arm portion extending from the proximal portion and a pawl portion formed at a front end portion of the arm portion, the slider body comprises an element guide passage formed between the upper blade and the lower blade and a pawl support portion which is provided on a top face of the upper blade so as to support the locking pawl body swingably in a vertical direction, and the locking pawl body is supported pivotally so as to project the pawl portion into the element guide passage usually, upon being urged by urging means having elasticity, and so as to retreat the pawl portion from the element guide passage upon receiving an operation, when the pull tab is operated.

4. The slide fastener slider according to claim 3, wherein the urging means is constituted of a leaf spring.

5. The slide fastener slider according to claim 4, wherein the leaf spring is provided separately from the locking pawl body and disposed on the slider body or the pull tab holder body.

6. The slide fastener slider according to claim 4, wherein the leaf spring is integrated with the locking pawl body.

7. The slide fastener slider according to claim 3, wherein the pull tab holder body is fixed to the upper blade or the pawl support portion by caulking.

* * * * *

UNITED STATES PATENT AND TRADEMARK OFFICE

CERTIFICATE OF CORRECTION

PATENT NO. : 7,870,650 B2
APPLICATION NO. : 12/045808
DATED : January 18, 2011
INVENTOR(S) : Keiichi Keyaki et al.

Figure 27:
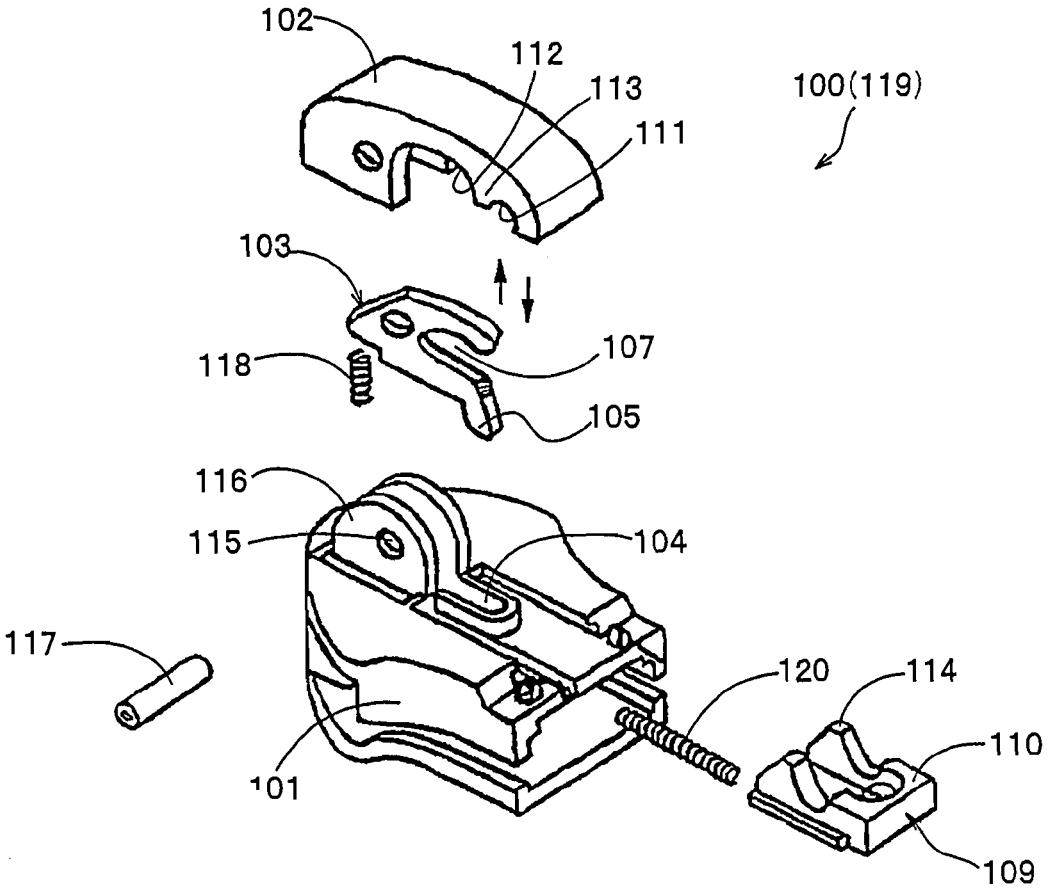
FIG. 27 PRIOR ART
FIG. 27 is an exploded perspective view of a conventional slider.
Figure 28:
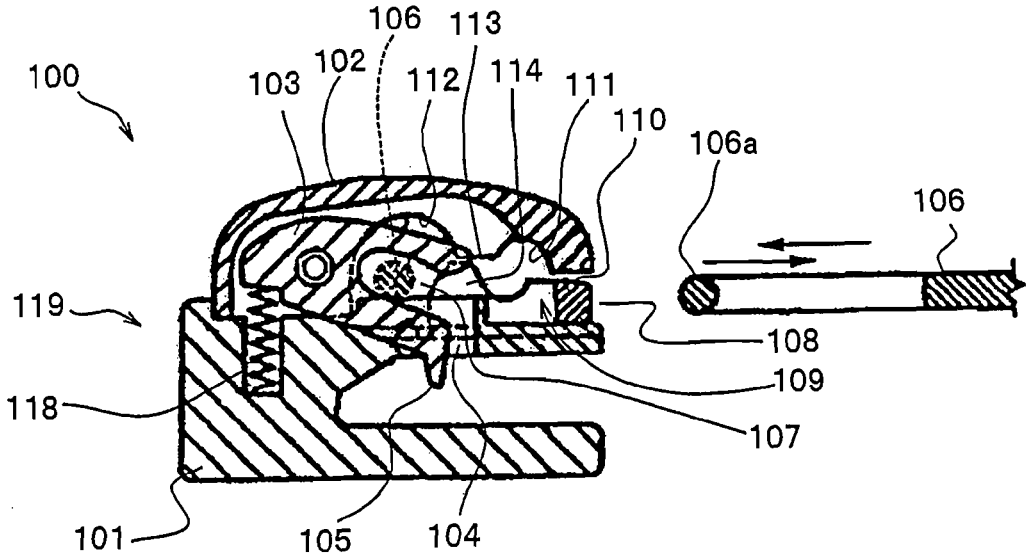
FIG. 28 PRIOR ART
FIG. 28 is a longitudinal sectional view showing a primary assembly of the conventional slider.
Figure 29:
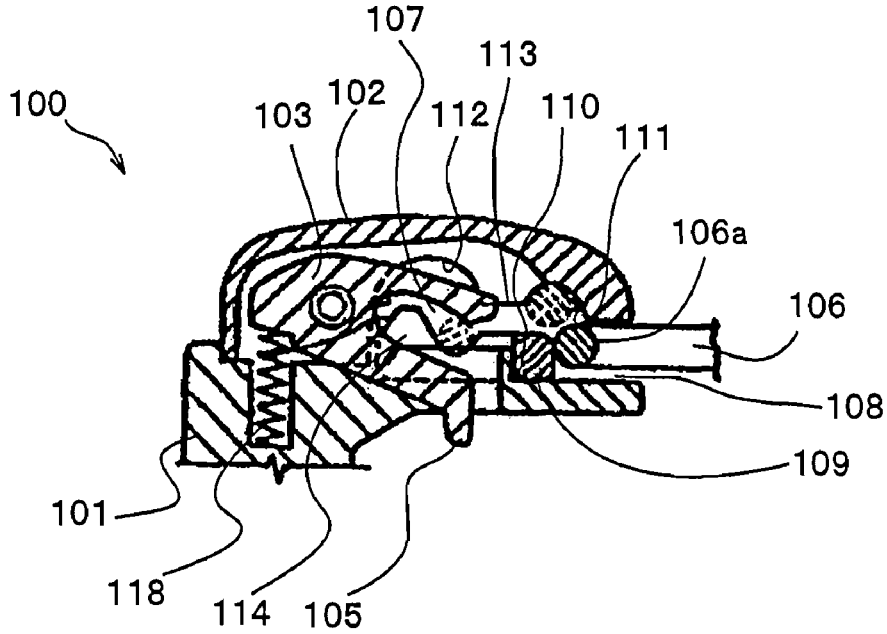
FIG. 29 PRIOR ART
FIG. 29 is a longitudinal sectional view for explaining the procedure for moving a pull tab into a recess space in the conventional slider.
Figure 30:
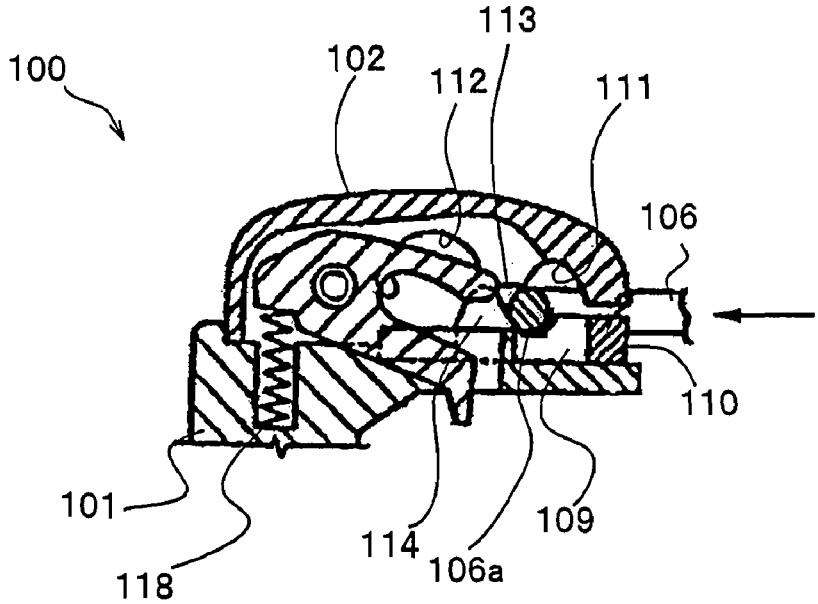
FIG. 30 PRIOR ART
FIG. 30 is a longitudinal sectional view for explaining the procedure for moving the pull tab from the recess space into an accommodating space in the conventional slider.

It is certified that error appears in the above-identified patent and that said Letters Patent is hereby corrected as shown below:

In the drawings:
On sheet 16 of 17, in figure 27, below reference numeral 117, line 1, below " 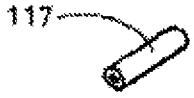 " delete " 101 " and insert -- 101 --.

In column 2, line 64, delete "form" and insert -- from --, therefor.

In column 19, line 2, delete "pinto" and insert -- pin to --, therefor.

In column 20, line 2, delete "maybe" and insert -- may be --, therefor.

Signed and Sealed this
Fifteenth Day of March, 2011

David J. Kappos

David J. Kappos
*Director of the United States Patent and Trademark Office*